US010022848B2

(12) United States Patent
Gross et al.

(10) Patent No.: US 10,022,848 B2
(45) Date of Patent: Jul. 17, 2018

(54) POWER TOOL DRIVE MECHANISM

(71) Applicant: Black & Decker Inc., Newark, DE (US)

(72) Inventors: Paul Gerard Gross, White Marsh, MD (US); Marco Alessandro Mattucci, Fallston, MD (US)

(73) Assignee: BLACK & DECKER INC., New Britain, CT (US)

( * ) Notice: Subject to any disclaimer, the term of this patent is extended or adjusted under 35 U.S.C. 154(b) by 650 days.

(21) Appl. No.: 14/444,982

(22) Filed: Jul. 28, 2014

(65) Prior Publication Data

US 2016/0023341 A1 Jan. 28, 2016

(51) Int. Cl.
*B25C 1/06* (2006.01)
*B25F 5/00* (2006.01)

(52) U.S. Cl.
CPC . *B25C 1/06* (2013.01); *B25F 5/00* (2013.01)

(58) Field of Classification Search
CPC ..... B25F 5/008; B25C 1/06
USPC ..... 227/147
See application file for complete search history.

(56) References Cited

U.S. PATENT DOCUMENTS 3,193,049 A 7/1965 Wollek
3,205,972 A 9/1965 Stricker et al.
3,302,047 A * 1/1967 Short ..... B25F 5/008 310/60 R
3,386,527 A 6/1968 Daubert et al.
3,829,722 A * 8/1974 Rosenthal, Jr. ..... B25F 5/008 310/50
4,042,036 A * 8/1977 Smith ..... B25C 1/005 124/10
4,121,745 A 10/1978 Smith et al.
4,189,080 A 2/1980 Smith et al.
4,204,622 A 5/1980 Smith et al.
4,323,127 A * 4/1982 Cunningham ..... B25C 1/06 124/78
4,346,205 A 8/1982 Hiles
4,493,677 A * 1/1985 Ikenoya ..... B62M 9/06 474/150
4,519,535 A 5/1985 Crutcher
4,544,090 A 10/1985 Warman et al.
4,562,589 A 12/1985 Warnaka et al.
(Continued)

FOREIGN PATENT DOCUMENTS

CN 1846947 10/2006
CN 101032813 9/2007
(Continued)

OTHER PUBLICATIONS

PCT International Search Report dated Jun. 29, 2015.
(Continued)

*Primary Examiner* — Hemant M Desai
*Assistant Examiner* — Lucas Palmer
(74) *Attorney, Agent, or Firm* — Stephen R. Valancius

(57) ABSTRACT

A cantilevered flywheel for a motor having an inner rotor. A power tool having an electric motor which drives a cantilevered flywheel. A fastening device having a driver blade and/or driver profile which has a driving action energized by a transfer of energy from contact with a cantilevered flywheel. Methods of using a cantilevered flywheel in power tools and appliances.

17 Claims, 27 Drawing Sheets

(56) References Cited

U.S. PATENT DOCUMENTS 4,928,868 A * 5/1990 Kerrigan ..... B25C 1/06 173/13
4,981,737 A 1/1991 Rico
5,069,379 A * 12/1991 Kerrigan ..... B25C 1/06 227/120
5,098,004 A 3/1992 Kerrigan
5,216,823 A 6/1993 Ripley
5,363,569 A 11/1994 Kadakia
5,723,923 A * 3/1998 Clagett ..... B64G 1/283 290/36 R
6,196,332 B1 * 3/2001 Albert ..... B25B 21/00 173/176
6,755,807 B2 6/2004 Risk, Jr. et al.
6,824,533 B2 11/2004 Risk, Jr. et al.
6,828,020 B2 12/2004 Fisher et al.
6,971,567 B1 * 12/2005 Cannaliato ..... B25C 1/06 173/1
7,091,635 B1 8/2006 Gilliland
7,165,305 B2 * 1/2007 Kenney ..... B25C 1/06 173/1
7,503,401 B2 * 3/2009 Gross ..... B25C 1/06 173/131
7,575,142 B2 8/2009 Liang et al.
7,686,199 B2 * 3/2010 Gross ..... B25C 1/06 227/10
7,793,811 B1 9/2010 Pedicini et al.
7,942,651 B2 * 5/2011 Bin-Nun ..... F25B 1/02 310/153
8,047,415 B2 11/2011 Kunz et al.
8,079,504 B1 12/2011 Pedicini et al.
8,096,456 B2 * 1/2012 Kunz ..... B25C 1/06 227/123
8,132,702 B2 3/2012 Kunz et al.
RE44,001 E 2/2013 Pedicini et al.
8,523,035 B2 9/2013 Pedicini et al.
8,550,324 B2 10/2013 Coleman
9,346,158 B2 * 5/2016 Garber ..... B25C 1/06
2004/0219322 A1 11/2004 Fisher et al.
2007/0210133 A1 * 9/2007 Oda ..... B25C 1/06 227/131
2009/0032567 A1 * 2/2009 Liang ..... B25C 1/06 227/131
2009/0095787 A1 * 4/2009 Liang ..... B25C 1/06 227/131
2009/0294505 A1 * 12/2009 Kunz ..... B25C 1/06 227/8
2009/0294508 A1 * 12/2009 Kunz ..... B25C 1/06 227/131
2010/0213232 A1 * 8/2010 Krondorfer ..... B25C 5/15 227/8
2011/0139478 A1 6/2011 Brennenstuhl
2011/0259938 A1 * 10/2011 Chien ..... B25C 1/06 227/129
2012/0001505 A1 * 1/2012 Henke ..... H02K 11/33 310/62
2012/0187178 A1 7/2012 Campbell
2014/0076952 A1 3/2014 Garber et al.
2014/0360744 A1 12/2014 Lawrence
2016/0023342 A1 * 1/2016 Koenig ..... B25F 5/00 227/147

FOREIGN PATENT DOCUMENTS

CN 102900806 1/2013
EP 0663269 7/1995
EP 2127819 12/2009
EP 2230050 9/2010
EP 2711135 3/2014
JP 4-101078 4/1992
WO WO 2004052595 A1 * 6/2004 ..... B25C 1/06
WO WO2004052595 4/2009

OTHER PUBLICATIONS

EP Search Report for EP Application No. 15178620.9 dated Dec. 15, 2015.
3M, Material Safety Data Sheet, Jul. 18, 2013, pp. 1-7, 3M Center, St.Paul, MN 44144-1000; Phone: (888) 364-3577.
Avery Dennison, Ultra High Adhesion Removable Adhesive Webpages, http://tapes.averydennison.com/en/home/products/rubber-based-adhesive/ultra-high-adhesion-uha-removable-adhesive.html, Avery Dennison, 207 Goode Avenue, Glenndale, CA 91205; Phone: (626) 304-2000.
3M Sheet—Sound Damping Foils when quiet is the sound of quality.
EP Supplemental Search Report dated Feb. 20, 2018, for EP Application No. 15827030.

* cited by examiner

POWER TOOL DRIVE MECHANISM

FIELD OF THE INVENTION

The present invention relates to a power tool drive mechanism.

BACKGROUND OF THE INVENTION

Fastening tools, such as nailers, are used in the construction trades. However, many fastening tools which are available are insufficient in design, expensive to manufacture, heavy, not energy efficient, lack power, have dimensions which are inconveniently large and cause operators difficulties when in use. Further, many available fastening tools do not adequately guard the moving parts of a nailer driving mechanism from damage.

Many fastening tools which are available are inconveniently bulky and have systems for driving a fastener which have dimensions that require the fastening tool to be larger than desired. For example, drive systems having a motor which turns a rotor can require clutches, transmissions, control systems and kinetic parts which increase stack up and limit the ability of a power tool to be reduced in size while retaining sufficient power to achieve a desired performance.

There is a strong need for a fastening tool having an improved motor and drive mechanism.

SUMMARY OF THE INVENTION

In an embodiment, a power tool can have an electric motor having a rotor which has a rotor shaft. The rotor shaft can be coupled to a flywheel which can have a portion which is cantilevered over at least a portion of the rotor. The flywheel can also have a contact surface adapted to impart energy from the flywheel when contacted by a moveable member. The overlapping portion can be adapted to rotate radially about at least a portion of the motor. The power tool can have a motor which has an inner rotor, or a motor which has an outer rotor. The flywheel can have a portion which is cantilevered over at least a portion of said rotor.

In an embodiment, a power tool can have an electric motor having a motor housing and a rotor having a rotor shaft. The rotor shaft can be coupled to a flywheel which can have a portion which is cantilevered over at least a portion of the motor housing. The flywheel can also have a contact surface adapted to impart energy from the flywheel when contacted by a moveable member. The overlapping portion can be adapted to rotate radially about at least a portion of the motor housing. The power tool can have a motor which has an inner rotor, or a motor which has an outer rotor.

The power tool can have an overlapping portion which supports a flywheel ring which can have a contact surface. Optionally, the contact surface can have a geared portion. The contact surface can optionally have at least one grooved portion. The contact surface can optionally have at least one toothed portion.

In an embodiment, the power tool can have a flywheel ring and a rotor shaft which rotate in a ratio in a range of 0.5:1.5 to 1.5:0.5; such as in a range of 1:1.5 to 1.5:1. In an embodiment, the power tool can have a flywheel ring and a rotor shaft which rotate in a ratio of about 1:1. In an embodiment, the power tool can have a flywheel ring and a rotor shaft which rotate in a ratio of 1:1. The power tool can also have a flywheel ring which rotates at a speed in a range of from about 2500 rpm to about 20000 rpm. The power tool can also have a flywheel ring which rotates at a speed in a range of from about 5600 rpm to about 10000 rpm. In another embodiment, the power tool can have a flywheel ring which has a contact surface which has a speed in a range of from about 20 ft/s to about 200 ft/s. In yet another embodiment, the power tool can have a flywheel ring which has an inertia in a range of from about 10 J(kg*m^2) to about 500 J(kg*m^2).

In an embodiment, the power tool can have a flywheel ring which rotates in a plane parallel to a driver profile centerline plane. The power tool can also have a moveable member which is a driver blade which has a driving action which is energized by a transfer of energy from contact of the driver blade with the flywheel. The power tool can also have a moveable member which is a driver profile which has a driving action which is energized by a transfer of energy from contact of the driver profile with the flywheel.

The power tool can be a cordless power tool. The power tool can be a cordless nailer and can be adapted to drive a nail. The power tool can also be driven by a power cord, or be pneumatic or receive power from another source.

In an embodiment, a fastening device can have a motor having a cantilevered flywheel. The cantilevered flywheel can have a contact surface adapted for frictional contact with a driving member adapted to drive a fastener. The fastening device can have a motor which has an inner rotor, or a motor which has an outer rotor. The motor can be a brushed motor or a brushless motor. The motor can be an inner rotor motor which can be a brushed motor or an outer rotor motor which can be a brushed motor. The motor can be an inner rotor motor which can be a brushless motor or an outer rotor motor which can be a brushless motor.

In an embodiment, the fastening device can also have a cupped flywheel. The cupped flywheel can have a flywheel ring. In an embodiment, at least a portion of the cupped flywheel can be cantilevered over at least a portion of said motor and/or motor housing. The cupped flywheel can have a contact surface. The cupped flywheel can have a geared flywheel ring.

In an embodiment, the cupped flywheel can have a mass in a range of from about 1 oz to about 20 oz. In another embodiment, the fastening device can have a cantilevered flywheel which can have a diameter in a range of from about 0.75 to about 12 inches. The cantilevered flywheel can be adapted to rotate at an angular velocity of from about 500 rads/s to about 1500 rads/s. The cantilevered flywheel can be adapted to have a flywheel energy in a range of from about 10 j to about 1500 j.

In an embodiment, the fastening device can have a driving member which is driven with a driving force of from about 2 j to about 1000 j. In another embodiment, the fastening device can have a driving member which is driven at a speed of from about 10 ft/s to about 300 ft/s. The fastening device can have a driving member which is a driver blade. The fastening device can have a driving member which is a driver profile.

The fastening device can have a direct drive mechanism. In an embodiment, the direct drive mechanism can have a cantilevered flywheel. In another aspect, the fastening device can have a drive mechanism which is clutch-free.

The fastening device can be a nailer and can be adapted to drive a fastener which is a nail.

In an embodiment, a power tool can have a motor having a rotor and a flywheel adapted for turning by the rotor. The flywheel can have a flywheel portion which is positioned radially over at least a portion of the motor. In an embodiment, the flywheel portion can be at least a part of a flywheel ring, or can be a flywheel ring. In an embodiment, the flywheel portion can be at least a part of a flywheel body, or a flywheel body. In an embodiment, the flywheel portion can be at least a part of a cupped flywheel, or a cupped flywheel.

In an embodiment, the power tool can have a flywheel which is a cupped flywheel. The flywheel body can have a flywheel inner circumference which is configured radially about at least a portion of the motor. In another embodiment, the power tool can have a flywheel which is a cupped flywheel and which has a flywheel ring having at least a part which positioned radially over at least a portion of the motor.

In an embodiment, the power tool can have a motor housing which houses at least a portion of the motor and a flywheel portion which is positioned radially over at least a portion of the motor housing.

In an embodiment, the power tool can have a flywheel adapted for clutch-free turning by the motor. In another embodiment, the power tool can have a flywheel adapted for transmission-free turning by the motor. In yet another embodiment, the power tool can have a flywheel which can be adapted for turning by the rotor in a ratio of 1 turn of the flywheel to 1 turn of the rotor. In even another embodiment, the power tool can have a flywheel which can be adapted for turning by the rotor in a ratio of 1.5 turn of the flywheel to 1 turn of the rotor to 1.0 turn of the flywheel to 1.5 turn of the rotor.

In an embodiment, the power tool can be a fastening device. In another embodiment, the power tool can be a fastening device adapted to drive a nail into a workpiece.

In an embodiment, a power tool can have a motor having a rotor axis and a flywheel adapted for turning by the motor. The flywheel can have a flywheel portion coaxial to the rotor axis and which is at least in part located over at least a portion of the motor. The power tool can have a flywheel body having a flywheel body portion which radially surrounds at least a portion of the motor. The power tool can have a cupped flywheel having a cupped flywheel portion which radially surrounds at least a portion of the motor. The power tool can have a cupped flywheel having a flywheel ring and in which a portion of the flywheel ring is adapted to rotate coaxial to the rotor axis. The power tool can have a flywheel portion which has a flywheel contact surface which is adapted to rotate coaxial to the rotor axis. In an embodiment, the flywheel contact surface which can be adapted to have a velocity of at least 10 ft/s and in which the flywheel contact surface can be adapted to revolve coaxially about the rotor axis.

In an embodiment, the power tool can have a flywheel portion which is a cantilevered portion. The power tool can have a flywheel portion which is cantilevered over at least a portion of the motor. The flywheel portion which is cantilevered over at least a portion of the motor can have a contact surface.

In another embodiment, the power tool can have a flywheel portion which is cantilevered over at least a portion of the motor and can have a geared flywheel ring. In yet another embodiment, the power tool can have a motor housing which houses at least a portion of the motor and in which the flywheel has a flywheel inner circumference which is configured radially about at least a portion of the motor and which has a flywheel motor clearance of greater than 0.02 mm.

The power tool can be a fastening device.

In addition to the disclosure of articles, apparatus and devices herein, this disclosure encompasses a variety of method of use and construction of the disclosed embodiment. For example, a method for driving a fastener, can have the steps of: providing a motor and a cantilevered flywheel adapted to be turned by the motor; providing a driving member adapted to drive a fastener into a workpiece; providing a fastener to be driven; configuring the cantilevered flywheel such that at least a portion of the cantilevered flywheel can be reversibly contacted with a portion of the driving member; operating the cantilevered flywheel at an inertia of from about 2 j to about 500 j; causing the driving member to reversibly contact at least a portion of the cantilevered flywheel; imparting a driving force in a range of from about 1 j to about 475 j to the driving member from the cantilevered flywheel; and driving the fastener into the workpiece. The motor which is provided can have an inner rotor or an outer rotor. Additionally, the motor provided can be a brushed motor or a brushless motor.

In an embodiment, the method of driving a fastener can also have the step of operating the cantilevered flywheel at a speed in a range of from about 2500 rpm to about 20000 rpm. In an embodiment, the method of driving a fastener can also have the step of operating the cantilevered flywheel at an angular velocity in a range of from about 250 rads/s to about 2000 rads/s.

In another embodiment, the method of driving a fastener can also have the steps of providing a fastener which is a nail; and driving the nail into the workpiece.

BRIEF DESCRIPTION OF THE DRAWINGS

The present invention in its several aspects and embodiments solves the problems discussed above and significantly advances the technology of fastening tools. The present invention can become more fully understood from the detailed description and the accompanying drawings, wherein.

Throughout this specification and figures like reference numbers identify like elements.

DETAILED DESCRIPTION OF THE INVENTION

The disclosed fastening tool can have of a wide variety of designs and can be powered by a number of power sources. For example, power sources for the fastening tool can be manual, pneumatic, electric, battery, combustion, solar or use other (or multiple) sources of energy, such as battery and electric powered. The fastening can be cordless or can have a power cord. In an embodiment, the fasten can have both a cordless mode and a mode in which a power cord is used.

Figure 7:
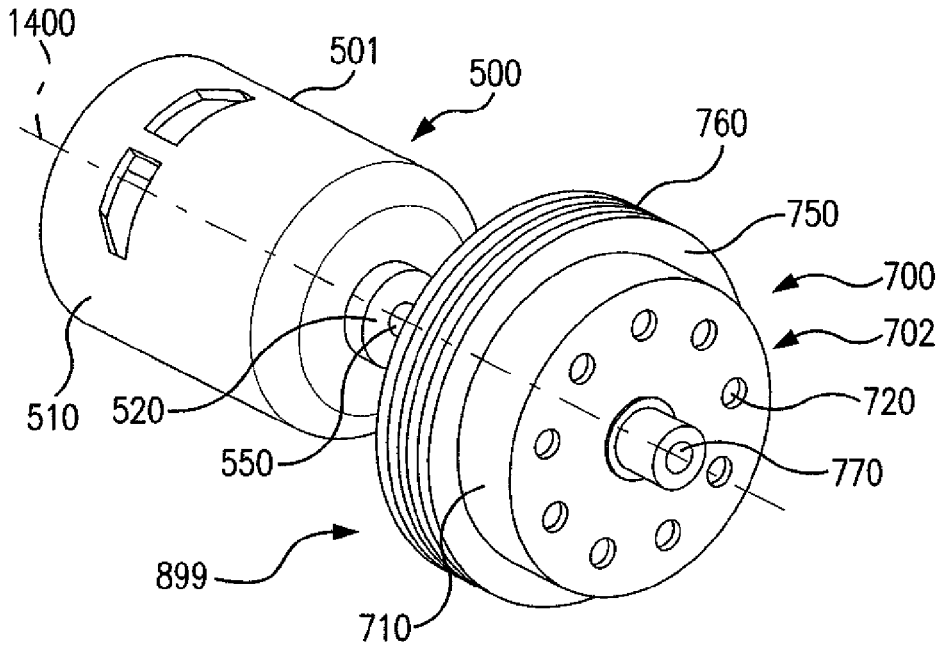
FIG. 7 is a perspective view of a cupped flywheel positioned for assembly onto an inner rotor motor.

In an embodiment, the power tool can be driven by an inner rotor motor 500 and a flywheel 700 which can be a cantilevered flywheel 899, such as a cupped flywheel 702 (e.g. FIG. 7). The inner rotor motor 500 can be a brushed motor 501, a brushless motor, or of another type. The inner rotor motor 500 can be in instant start motor and can drive an instant start flywheel and/or fastening device driver.

The disclosed use of the cantilevered flywheel 899, such as the cupped flywheel 702 achieve numerous benefits, such as allowing brushed motors to be used, significant reductions in manufacturing cost, smaller and lighter power tools. In embodiments, the inner rotor motor 500 with the flywheel 700 can drive a clutch-free (clutchless) and/or transmission-free direct drive mechanism. The inner rotor motor 500 with the cantilevered flywheel 899 achieves an efficient direct drive system for a flywheel to drive action in a power tool and/or fastening device.

The power tool drive mechanism disclosed herein can be used with a broad variety of fastening tools, including but not limited to, nailers, drivers, riveters, screw guns and staplers. Fasteners which can be used with the magazine 100 (e.g. FIG. 1) can be in non-limiting example, roofing nails, finishing nails, duplex nails, brads, staples, tacks, masonry nails, screws and positive placement/metal connector nails, rivets and dowels.

In an embodiment in which the fastening tool is a nailer. Additional areas of applicability of the present invention can become apparent from the detailed description provided herein. The detailed description and specific examples herein are not intended to limit the scope of the invention. This disclosure and the claims of this application are to be broadly construed.

Figure 1:
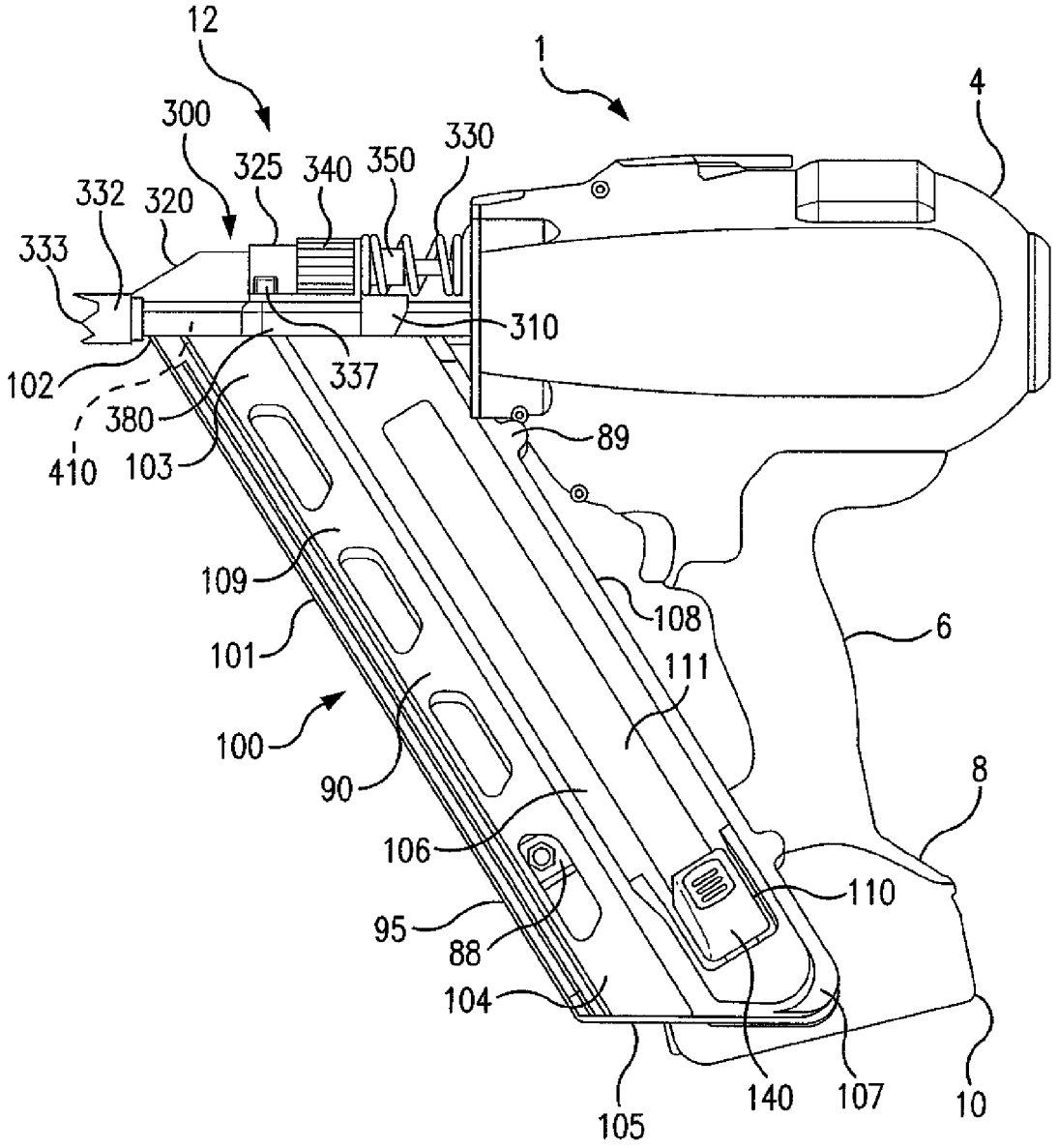
FIG. 1 is a knob-side side view of an exemplary nailer having a fixed nosepiece assembly and a magazine.

FIG. 1 is a side view of an exemplary nailer having a magazine viewed from the knob-side 90 (e.g., FIG. 1 and FIG. 3) and showing the pusher assembly knob 140. The embodiment of FIG. 1 shows a magazine 100 which is constructed according to the principles of the present invention is shown in operative association with a nailer 1. In this example, FIG. 1's nailer 1 is a cordless nailer. However, the nailer can be of a different type and/or a power source which is not cordless.

Nailer 1 has a housing 4 and a motor having an inner rotor, herein as "inner rotor motor 500", (e.g. FIG. 7) which can be covered by the housing 4. In the embodiment of FIG. 1, the inner rotor motor 500 drives a nail driving mechanism for driving nails which are fed from the magazine 100. The terms "driving" and "firing" are used synonymously herein regarding the action of driving or fastening a fastener (e.g. a nail) into a workpiece. A handle 6 extends from housing 4 to a base portion 8 having a battery pack 10. Battery pack 10 is configured to engage a base portion 8 of handle 6 and provides power to the motor such that nailer 1 can drive one or more nails which are fed from the magazine 100.

Nailer 1 has a nosepiece assembly 12 which is coupled to housing 4. The nosepiece can be of a variety of embodiments. In a non-limiting example, the nosepiece assembly 12 can be a fixed nosepiece assembly 300 (e.g. FIG. 1), or a latched nosepiece assembly 13 (e.g. FIG. 4).

The magazine 100 can optionally be coupled to housing 4 by coupling member 89. The magazine 100 has a nose portion 103 which can be proximate to the fixed nosepiece assembly 300. The magazine 100 can engage the fixed nosepiece assembly 300 at a nose portion 103 of the magazine 100 which has a nose end 102. In an embodiment, the fixed nosepiece assembly 300 can fit with the magazine 100 by a magazine interface 380. In an embodiment, the magazine screw 337 can be screwed to couple the fixed nosepiece assembly 300 to the magazine 100, or unscrewed to decouple the magazine 100 from the fixed nosepiece assembly 300.

The magazine 100 can be coupled to a base portion 8 of a handle 6 at a base portion 104 of magazine 100 by base coupling member 88. The base portion 104 of magazine 100 is proximate to a base end 105. The magazine can have a magazine body 106 with an upper magazine 107 and a lower magazine 109. An upper magazine edge 108 is proximate to and can be attached to housing 4. The lower magazine 109 can have a lower magazine edge 101.

Figure 5:
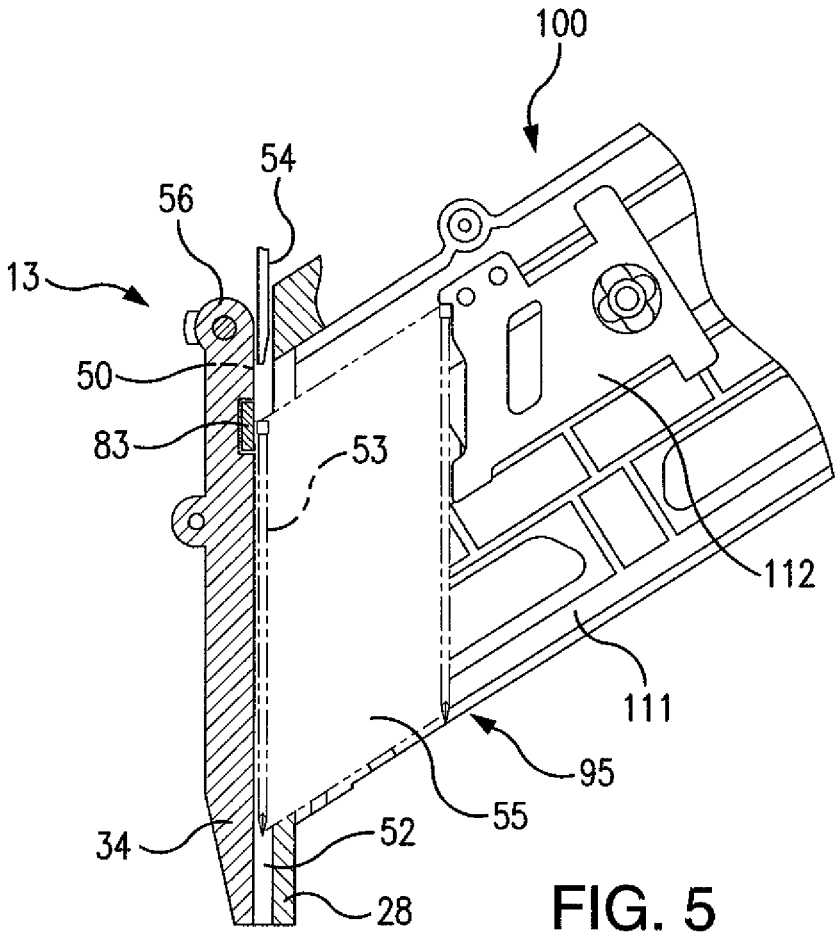
FIG. 5 is a side sectional view of the latched nosepiece assembly.

The magazine 100 can include a nail track 111 sized to accept a plurality of nails 55 therein (e.g. FIG. 5). The nails can be guided by a feature of the upper magazine 107 which guides at least one end of a nail, such as a nail head. The lower magazine 109 can guide a portion of a nail, such as a nail tip supported by a lower liner 95. The plurality of nails 55 can be moved through the magazine 100 towards nosepiece assembly 12 by a force imparted by contact from the pusher assembly 110.

FIG. 1 illustrates an example embodiment of the fixed nosepiece assembly 300 which has an upper contact trip 310 and a lower contact trip 320. The lower contact trip 320 can be guided and/or supported by a lower contact trip support 325. The fixed nosepiece assembly 300 can have a nose 332 which can have a nose tip 333. When the nose 332 is pressed against a workpiece, the lower contact trip 320 and the upper contact trip 310 can be moved toward the housing 4 which can compress a contact trip spring 330. A depth adjustment wheel 340 can be moved to affect the position of a depth adjustment rod 350. In an embodiment, the depth adjustment wheel 340 can be a thumbwheel. The position of the depth adjustment rod also affects the distance between nose tip 333 and insert tip 355 (e.g. FIG. 3). A detail of a nosepiece insert 410 can be found in FIG. 3.

The magazine 100 can hold a plurality of nails 55 (FIG. 6) therein. A broad variety of fasteners usable with nailers can be used with the magazine 100. In an embodiment, collated nails can be inserted into the magazine 100 for fastening.

Figure 2:
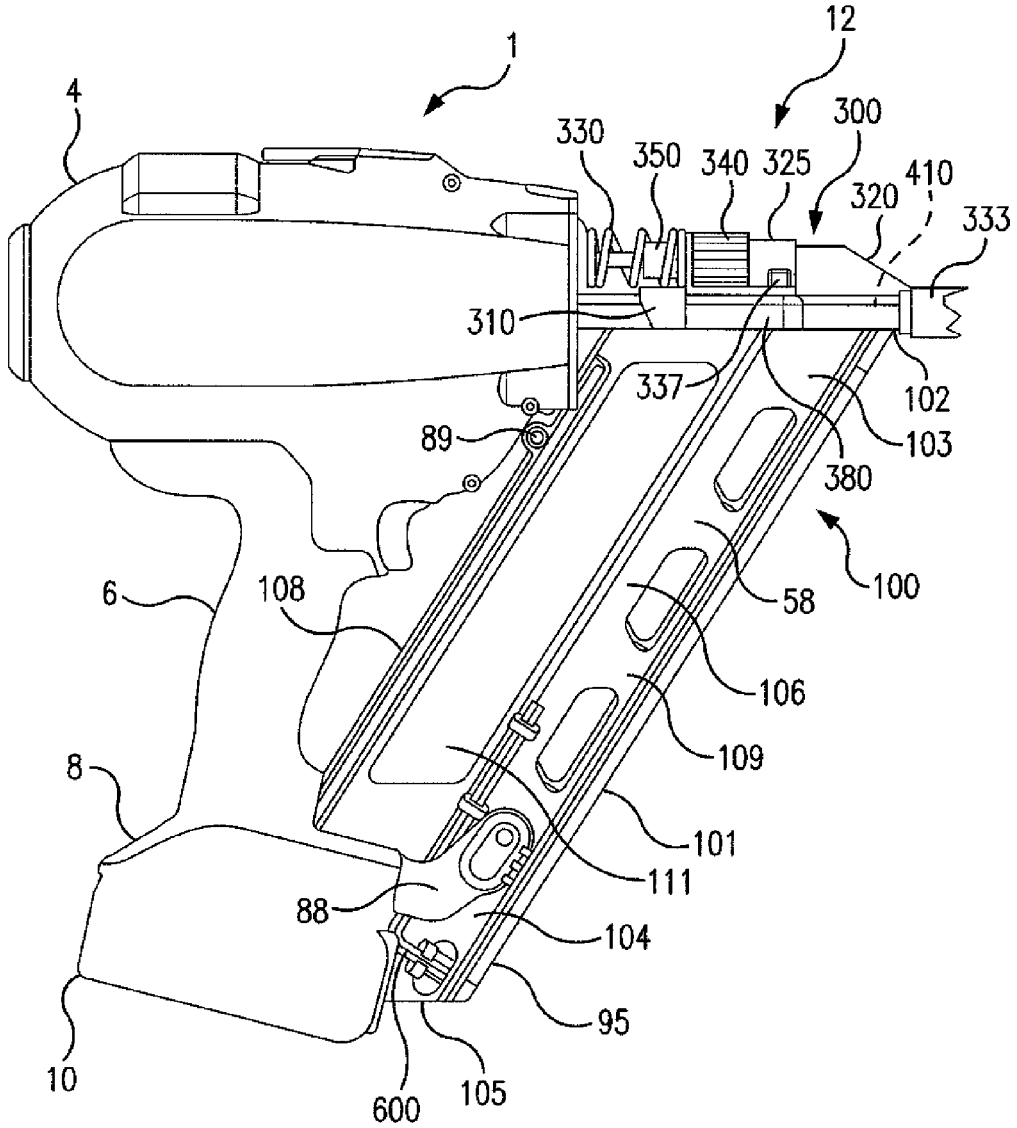
FIG. 2 is a nail-side view of an exemplary nailer having the fixed nosepiece assembly and the magazine.

FIG. 2 is a side view of exemplary nailer 1 having a magazine 100 and is viewed from a nail-side 58. Allen wrench 600 is illustrated as reversibly secured to the magazine 100.

Figure 3:
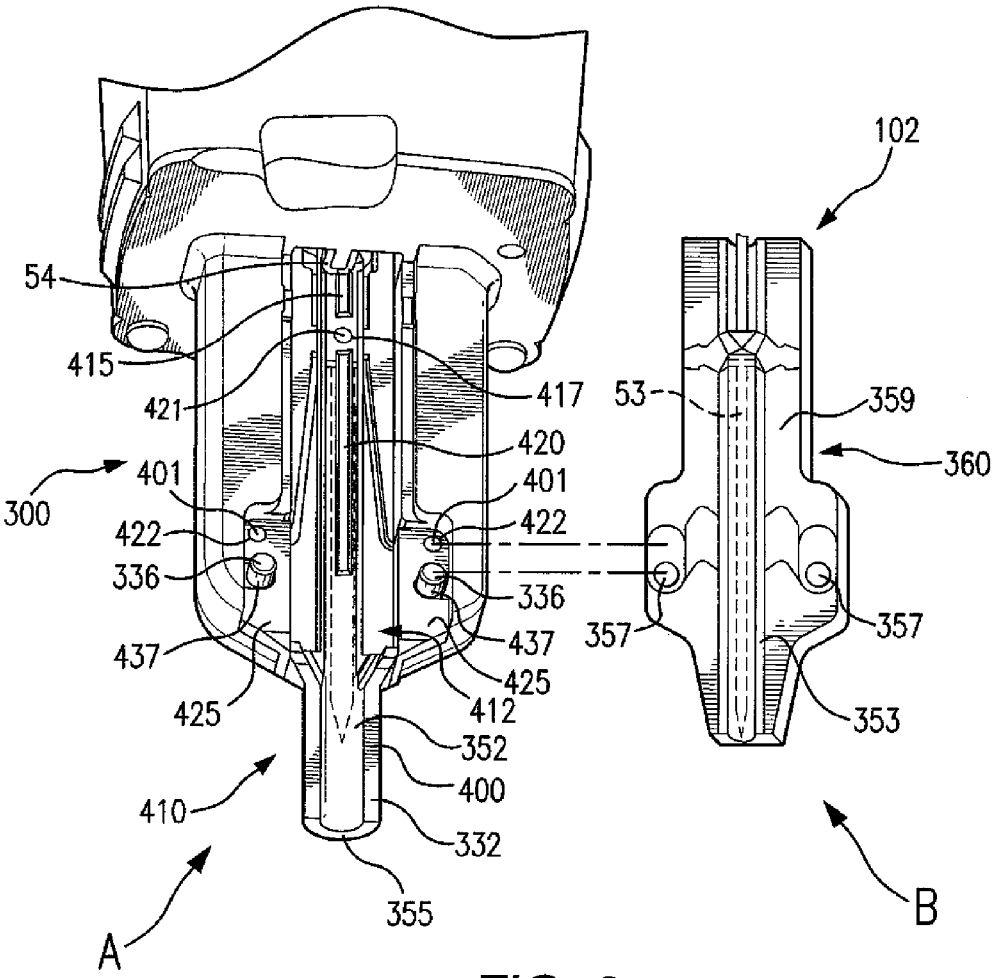
FIG. 3 is a detailed view of the fixed nosepiece with a nosepiece insert and a mating nose end of the magazine.

FIG. 3 is a detailed view of a fixed nosepiece with a nosepiece insert and a mating nose end of a magazine. FIG. 3 is a detailed view of the nosepiece assembly 300 from the channel side 412 which mates with the nose end 102 of the magazine 100.

FIG. 3 detail A illustrates a detail of the nosepiece insert 410 from the channel side 412. The nosepiece insert 410 has the rear mount screw hole 417 for the nail guide insert screw 421. Nosepiece insert 410 can also have a blade guide 415 and nail stop 420. The driver blade 54 can extend from the drive mechanism into channel 52. Nosepiece insert 410 can be fit to nosepiece assembly 300 and can have an interface seat 425. Nosepiece insert 410 can also have a nosepiece insert screw hole 422 and a magazine screw hole 336. Optionally, insert screw 401 for mounting the nosepiece insert 410 to the fixed nosepiece assembly 300 can be a rear mounted screw or a front mounted screw. Optionally, one or more prongs 437 respectively having a screw hole 336 for the magazine screw 337 can be used. In an embodiment, a nail channel 352 can be formed when the nosepiece insert 410 is mated with the nose end 102 of the magazine 100.

FIG. 3 detail B is a front detail of the face of the nose end 102 having nose end front side 360. The nose end 102 can have a nose end front face 359 which fits with channel side 412. The nose end 102 can have a nail track exit 353. For example, a loaded nail 53 is illustrated exiting nail track exit 353. FIG. 3 detail B also illustrates a screw hole 357 for magazine screw 337. In an embodiment, nosepiece insert 410 (FIG. 3) having nose 400 with insert tip 355 is inserted into the fixed nosepiece assembly 300.

Figure 4:
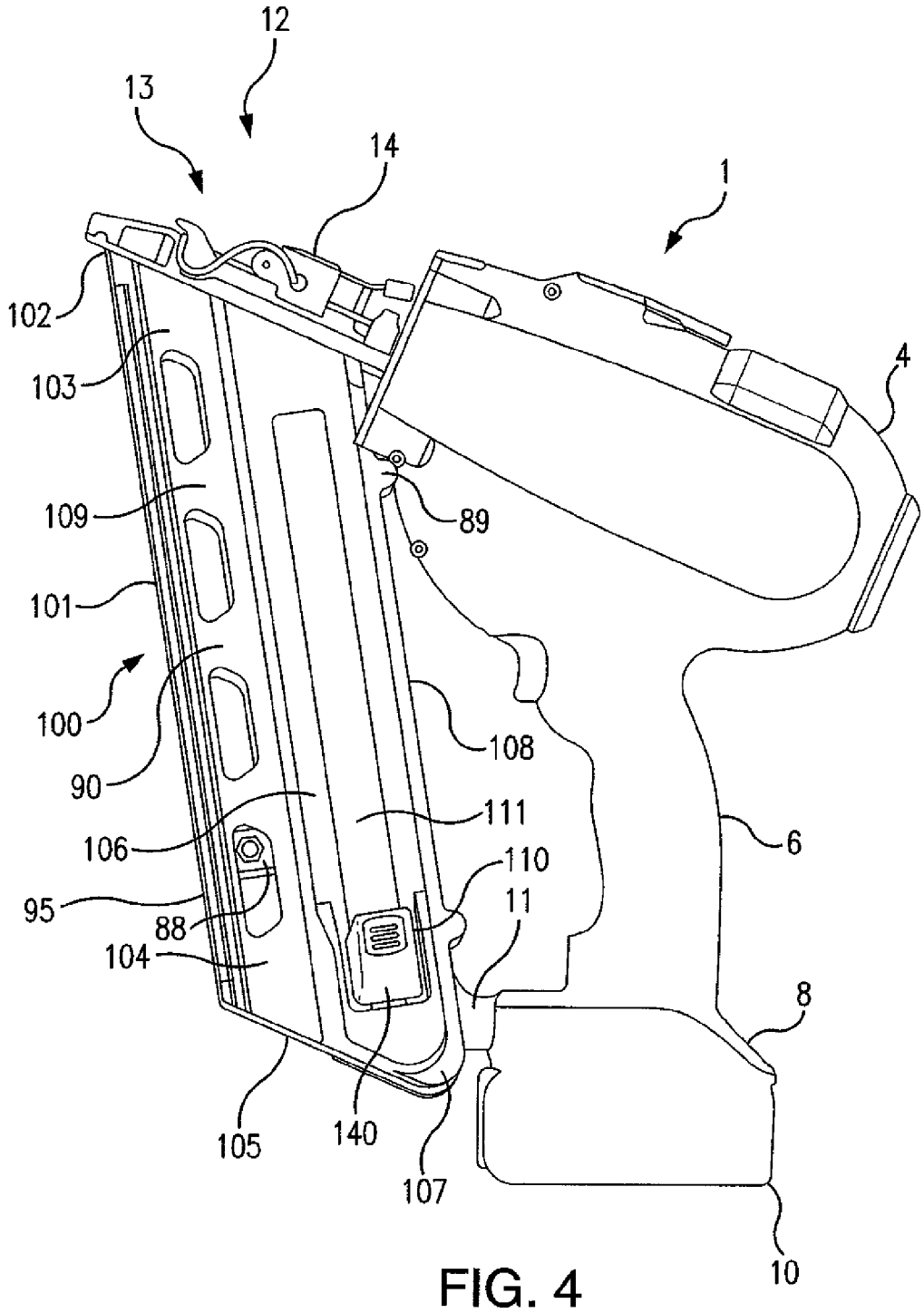
FIG. 4 is a perspective view of the latched nosepiece assembly of the nailer having a latch mechanism.

FIG. 4 is a side view of another embodiment of exemplary nailer 1 viewed from the knob-side 90. In this embodiment, the nosepiece assembly 12 is a latched nosepiece assembly 13 having a latch mechanism 14. Also in this embodiment, the magazine 100 is coupled to the housing 4 and coupled to the base 8 of the handle 6 by bracket 11.

FIG. 5 is a side sectional view of the latched nosepiece assembly 13 having a nail stop bridge 83. In an example embodiment, channel 52 can be formed from two or more pieces, e.g. nose cover 34 and at least one of groove 50 and nosepiece 28 (and/or nail stop bridge 83). Nosepiece 28 has a groove 50 formed therein which cooperates with the nose cover 34 (when the nose cover 34 is in its locked position). The locking of nose cover 34 against groove 50 can form an upper portion of channel 52. The driver blade 54 can extend from the drive mechanism into channel 52. The driver blade 54 can engage the head of the loaded nail 53 to drive loaded nail 53. Cam 56 prevents escape of driver blade 54 from the nosepiece 28. The nail stop bridge 83 that bridges the channel 52 engages each nail of the plurality of nails 55 as they are pushed by the pusher 112 along the nail track 111 of the magazine 100 and into channel 52. The tips of the plurality of nails 55 can be supported by the lower liner 95, or a lower support.

Figure 6:
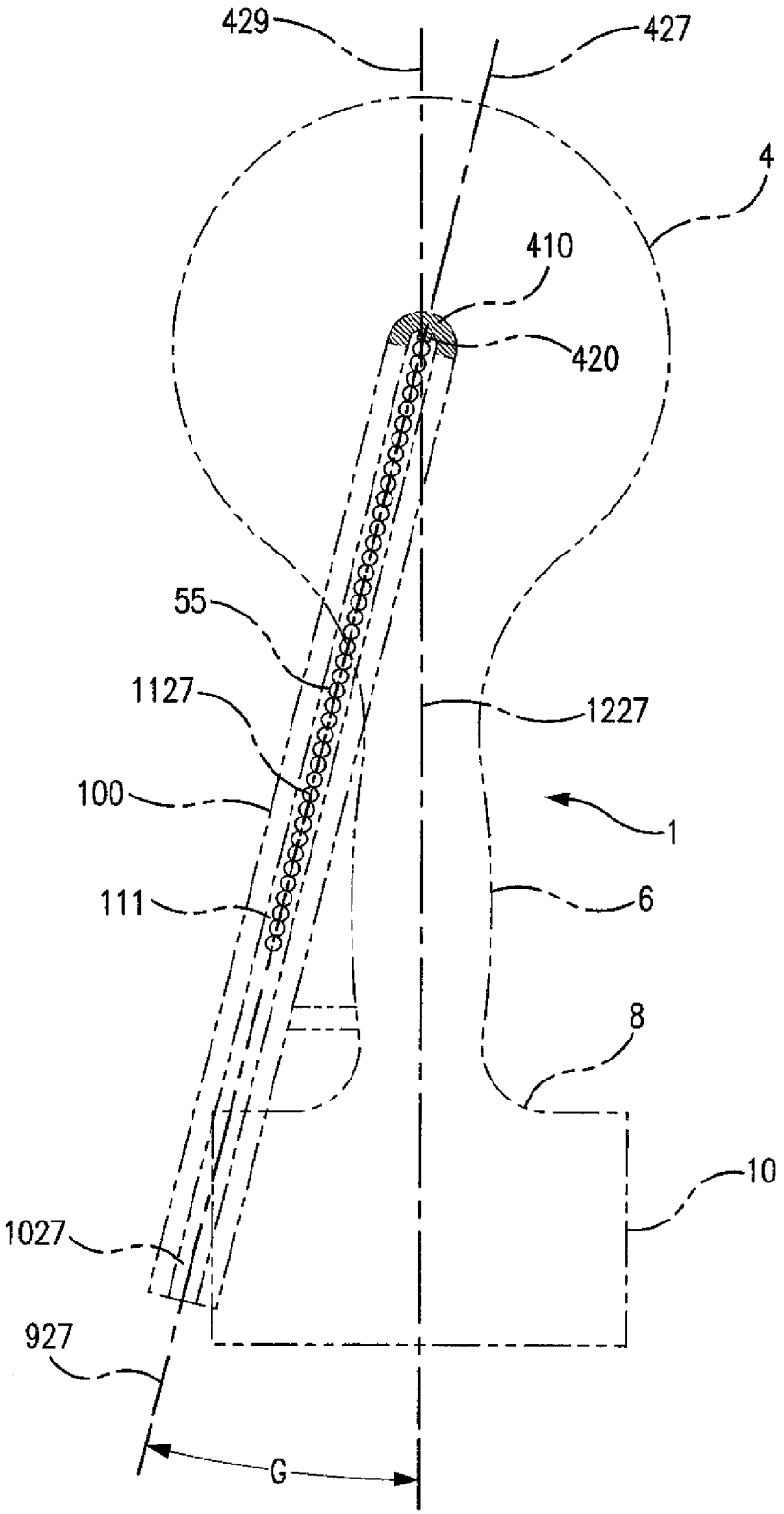
FIG. 6 is a perspective view illustrating the alignment of the nailer, magazine and nails.

FIG. 6 illustrates the nail stop 420, the nail stop centerline 427, a longitudinal centerline 927 of the magazine 100, a longitudinal centerline 1027 of the nail track 111, a longitudinal centerline 1127 of the plurality of nails 55 and a longitudinal centerline 1227 of the nailer 1. FIG. 6 illustrates that in an embodiment having fixed nosepiece 300 having nosepiece insert 410 can be mated with the nose end 102 channel centerline 429 can be collinear with nail 1 centerline 1029. Like reference numbers in FIG. 1 identify like elements in FIG. 6. In an embodiment, the magazine 100 can have its longitudinal centerline 927 offset from a longitudinal centerline 1227 of nailer 1 by an angle G. Angle G can be 14 degrees. In an embodiment, nail stop centerline 427 can be collinear with a longitudinal centerline 927 of the magazine 100. Additionally, in an embodiment, longitudinal centerline 927 of the magazine 100 can be collinear with a longitudinal centerline 1027 of the nail track 111, as well as collinear with a nail stop centerline 427. Longitudinal centerline 1127 of the plurality of nails 55 can be collinear with nail stop centerline 427. Nail stop centerline 427 can be offset as shown in FIG. 6 at an angle G measured from nailer 1 channel centerline 429. In an embodiment, angle G aligns the longitudinal centerline 1027 of the nail track 111 with the centerline 1127 of the plurality of nails 55 and also nail stop centerline 427.

Figure 10A:
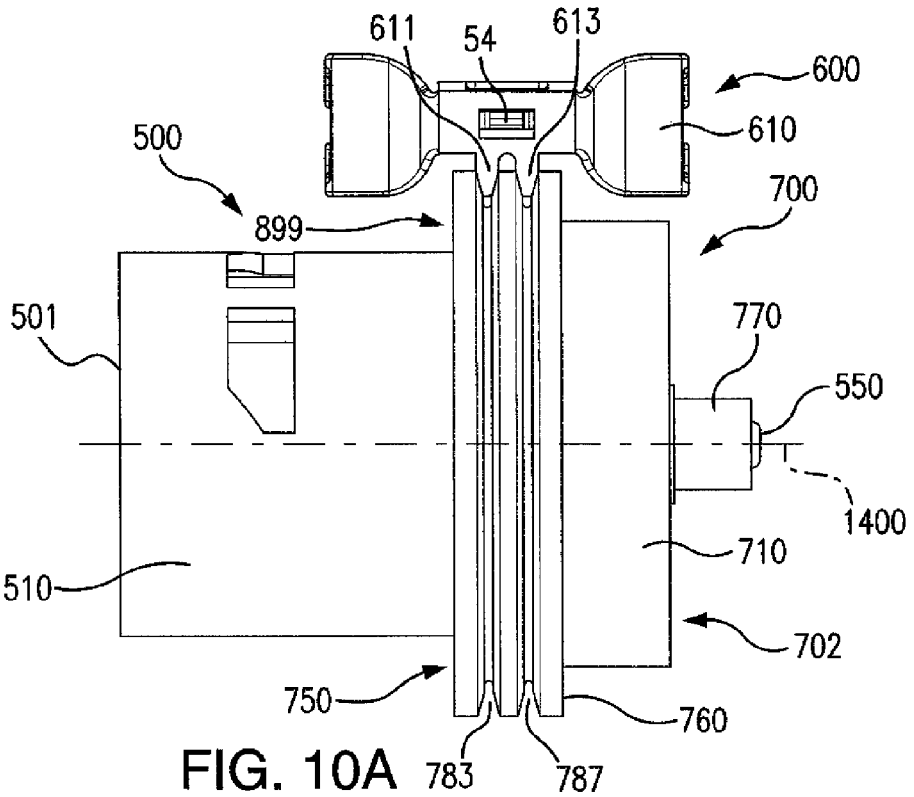
FIG. 10A a side view of a drive mechanism having the cupped flywheel which is frictionally engaged with a driver profile.

FIG. 7 is a perspective view of the cupped flywheel positioned for assembly onto an inner rotor motor 500. FIG. 7 illustrates the inner rotor motor 500 having a motor housing 510 and a first housing bearing 520 which bears a rotor shaft 550 driven by an inner rotor 540 (FIG. 10A). In an embodiment, the motor used can alternatively be a frameless motor which does not include a motor housing, or which can have only a partial motor housing which covers part of a longitudinal length of the motor. FIG. 7 also illustrates a flywheel 700 which is a cantilevered flywheel 899 and which in the embodiment of FIG. 7 is the cupped flywheel 702. The cupped flywheel 702 is shown in a disassembled state and in coaxial alignment with a rotor centerline 1400. The cupped flywheel 702 is shown in an assembled state, for example in FIGS. 10A and 10B. In an embodiment, the cupped flywheel 702 can have a flywheel body 710 and at least one of a flywheel opening 720 and/or a plurality of flywheel openings 720. Herein, both a single flywheel opening and a number of flywheel openings are designated by the reference numeral "720". There is no limitation at to the number flywheel openings which can be used. Such openings achieve a reduction and/or tailoring of the mass of the flywheel to meet structural, inertial and power consumption specifications. In an embodiment, the cupped flywheel 702 can have a flywheel ring 750 which can be a geared flywheel ring 760. Optionally, the cupped flywheel 702 can have a flywheel bearing 770 which interfaces with the rotor shaft 550.

Figure 8:
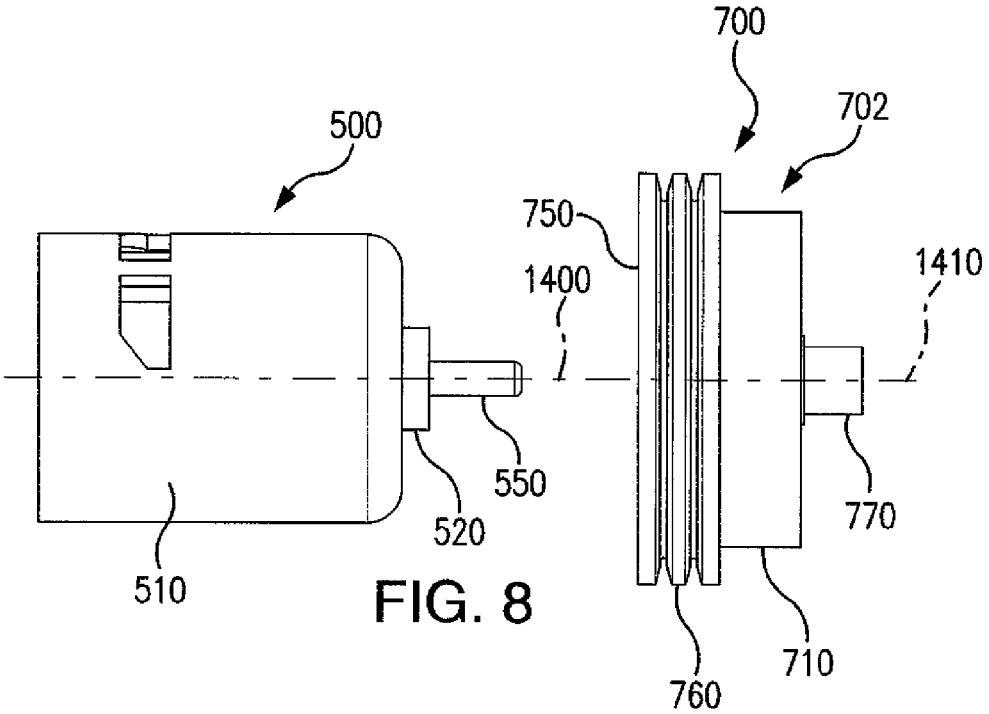
FIG. 8 is a side view of the cupped flywheel positioned for assembly onto the inner rotor motor.

FIG. 8 is a side view of the cupped flywheel positioned for assembly onto the inner rotor motor 500. As illustrated in FIG. 8, the cupped flywheel can be positioned such that a flywheel axial centerline 1410 is collinear with a rotor centerline 1400. In an embodiment, the cupped flywheel 702 can be frictionally attached to the rotor shaft 550 by means of fitting the flywheel bearing 770 onto a portion of the rotor shaft 550. In other embodiments, the cupped flywheel 702 can be affixed to the rotor shaft 550 by other means, such as using a lock and key configuration, using a "D" shaped shaft portion mated with a "D" shaped portion of the flywheel bearing 770, using fasteners such a screw, a linchpin, a bolt, a wed, or any other means which attached the cupped flywheel 702 to the rotor shaft 550. In an embodiment, the inner rotor 540 and/or the rotor shaft 550 and the cupped flywheel 702 and/or the flywheel bearing 770 can be manufactured as one piece, or multiple pieces.

Figure 9:
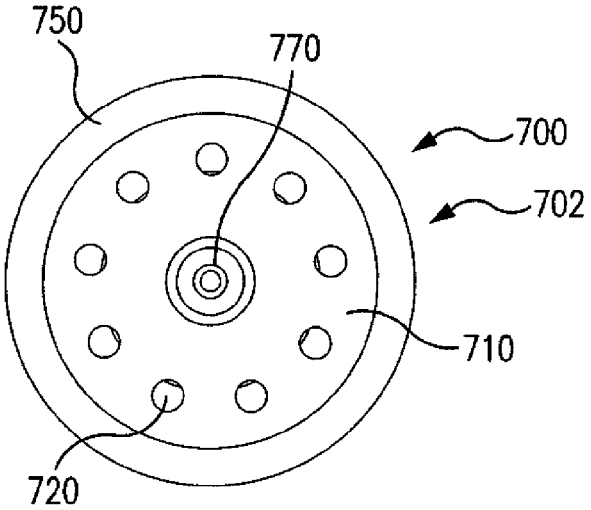
FIG. 9 is a front view of the cupped flywheel.

FIG. 9 is a front view of the cupped flywheel 702 having a number of the flywheel opening 720. The flywheel ring 750 is shown extending radially away from the center of the cupped flywheel 702 and the flywheel bearing 770. There is no limitation to the number of flywheel rings which can be used. Optionally, one or more flywheel rings can be located along the length of the cupped flywheel 702. Each flywheel ring can have a contact surface to impart energy to a moveable member. Multiple flywheel rings can power multiple members, or the same member.

FIG. 10A is a side view of a drive mechanism having the cupped flywheel 702 which is frictionally engaged with a driver profile 610. In FIG. 10A, the mating of the flywheel ring 750 with the driver profile 610 is shown. There is no limitation as to the means by which the flywheel 700 imparts energy to the driver 600, driver profile 610 and/or driver blade 54. In the example of FIG. 10A, the flywheel ring 750 is a geared flywheel ring 760 having a first gear groove 783 and a second gear groove 787 which is shown in frictional contact with driver profile 610 and more specifically a first profile tooth 611 and a second profile tooth 613. By this frictional contact, at least a portion of the rotational energy developed in the cupped flywheel 702 is imparted to the driver profile 610 propelling the driver profile through a driving action to cause the driver blade 54 born by the driver profile 610 to drive a nail 53.

Figure 10B:
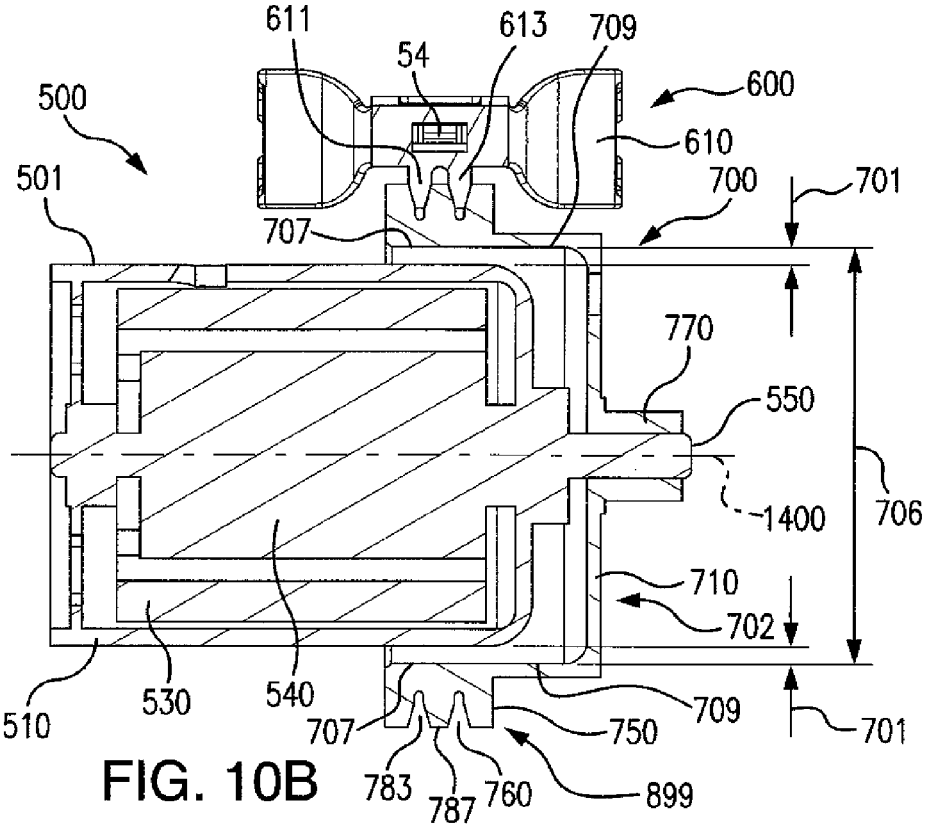
FIG. 10B is a cross-sectional view of the drive mechanism having the cupped flywheel which is frictionally engaged with the driver profile.

FIG. 10B is a cross-sectional view of a drive mechanism having the cupped flywheel 702 which is frictionally engaged with the driver profile 610. In FIG. 10B, the cross-sectional view illustrates the cantilevered nature of the flywheel ring 750 over at least a portion of the inner rotor motor 500. In an embodiment, the flywheel ring 750 can be cantilevered over the entirety of the inner rotor motor 500, or any portion of the inner rotor motor 500. In the embodiment of FIG. 10B, the cup shape of the cupped flywheel 702 when coupled to the rotor shaft 550 as illustrated in FIG. 10B configures the flywheel ring 750 radially and in a cantilevered configuration about at least a portion of inner rotor motor 500 and/or motor housing 510 and/or rotor 540. The flywheel ring 750 can be positioned along the rotor centerline 1400 at a position at which the flywheel ring 750 is positioned such that a portion of each of the motor housing 510, the stator 530, the inner rotor 540 and the rotor shaft 550 is radially within a flywheel ring inner circumference 707. The flywheel ring inner circumference 707 can have a diameter which optionally is the same or different from the flywheel inner diameter 706. The flywheel ring inner circumference 707 can be separated from the motor housing 510 by a flywheel motor clearance 701. There is no limitation as to the dimension of the flywheel motor clearance 701. The clearance 701 can be in a range of from less than a millimeter to one foot or more, such as 0.02 mm, 0.05 mm, 1 mm, 2 mm, 3 mm, 4 mm, 5 mm, 7.5 mm, 10 mm, 15 mm or 25 mm, or greater. For example, in an embodiment of a power tool the clearance can be in a range of from 0.02 mm to 10 mm can be used. In another non-limiting example for larger industrial equipment a clearance of 5 mm to 25 mm or greater, can be used.

In the example embodiment of FIB. 10B, the flywheel ring inner circumference 707 can be the same as a flywheel inner circumference 709. The flywheel inner circumference 709 can be the same or different from the flywheel ring inner circumference 707. The flywheel inner circumference 709 can have any dimension which is separated from the motor housing 510 by a clearance. The flywheel inner circumference 709 can be at least in part over at least a portion of the inner rotor motor 500 and/or the motor housing 510. The flywheel inner circumference 709 can at least in part radially encompass at least a part of inner rotor motor 500 and/or the motor housing 510.

The driving action of the driver profile 610 can be used to drive a fastener, such as a nail 53, into a workpiece. FIGS. 11, 12, 12B and 13 disclose a selection of steps taking from a driving action of the driver profile 610. The driver profile 610 can be driven by a frictional contact with the flywheel 700 which can be the cantilevered flywheel 899. In an embodiment, the driver profile 610 can have a driver blade 54 which can be propelled to physically contact the fastener such that the fastener is driven into a workpiece. In an embodiment, the fastener can be a nail 53. The driving action of the driver profile 610 can begin when the driver profile 610 makes contact with the flywheel 700 which can be a cantilevered flywheel 899, such as the cupped flywheel 702. Upon contact by the driver profile 610 with the flywheel 700, the driver profile 610 can be propelled toward the nosepiece 12 and a fastener such as a nail 53 positioned in the nosepiece 12 for driving into a work piece. The driver profile 610 and/or the driver blade 54 can physically contact the fastener such that the fastener is driven into a workpiece. After the fastener is driven into the workpiece, the driver profile 610 can return to its resting position. In an embodiment, the driver profile 610 can be driven by means of frictional contact by the flywheel 750 of the cupped flywheel 702.

Figure 11:
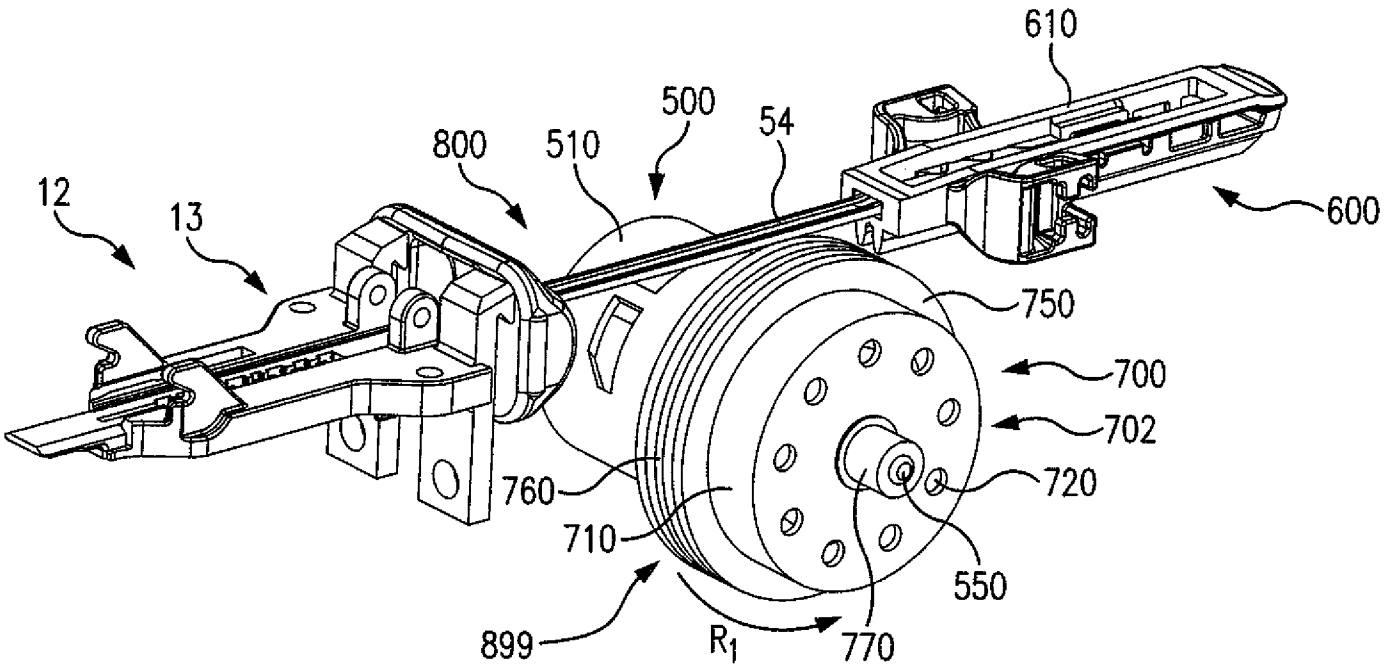
FIG. 11 is a perspective view of the drive mechanism having the cupped flywheel and the driver which is in a resting state.

FIG. 11 is a side view of a drive mechanism having the cupped flywheel 702 and a driver profile 610 which is in a resting state. In FIG. 11, the driver profile 610 has a portion proximate to but not touching the flywheel ring 750 of the cupped flywheel 702. In FIG. 11, the driver blade 54 is shown extending from its seating in the driver profile 610 to the latched nosepiece assembly 13 and its parts, such as the nosepiece 28. The flywheel 700 can rotate at a speed and an angular velocity.

Numeric values and ranges herein, unless otherwise stated, are intended to have associated with them a tolerance and to account for variances of design and manufacturing. Thus, a number is intended to include values "about" that number. For example, a value X is also intended to be understood as "about X". Likewise, a range of Y-Z, is also intended to be understood as within a range of from "about Y-about Z". Unless otherwise stated, significant digits disclosed for a number are not intended to make the number an exact limiting value. Variance and tolerance is inherent in mechanical design and the numbers disclosed herein are intended to be construed to allow for such factors (in non-limiting e.g., ±10 percent of a given value). Likewise, the claims are to be broadly construed in their recitations of numbers and ranges.

In the embodiment of FIG. 11, the cantilevered flywheel 899 is shown to be the cupped flywheel 702. There is no limitation regarding the diameter or dimensions of any of the various embodiments of the flywheel 700 disclosed herein, such as the cantilevered flywheel 899 which can be the cupped flywheel 702, or other type of cantilevered flywheel having at least a portion projecting over at least a portion of the inner rotor motor 500. In other example embodiments, the flywheel 700 can have a number of flywheel struts 713 (FIG. 18G), or flywheel 700 can have a flywheel mesh structure 740 (FIG. 18F), or other structure. Any of the flywheels disclosed herein can have a diameter from small to quite large, such as in a range of from less than 0.5 inches to greater than 24 inches. For example cupped flywheel 702 can have a portion, such as a flywheel body portion 710 and/or a flywheel outer diameter 704 (FIG. 19A) having a diameter which can be 0.05 in, 1.0 in, 1.5 in, 2.0 in, 3.0 in, 4.0 in, 5.0 in, 6.0 in, 7.0 in, 8.0 in, 9.0 in, 10.0 in, 11.0 in, 12.0 in, 12.6 in, 15 in, 18 in, 24 in. The flywheel ring 750 can also have an outer diameter 751 which can be 0.05 in, 1.0 in, 1.5 in, 2.0 in, 3.0 in, 4.0 in, 5.0 in, 6.0 in, 7.0 in, 8.0 in, 9.0 in, 10.0 in, 11.0 in, 12.0 in, 12.6 in, 15 in, 18 in, 24 in. Additionally, there is no limitation to the structural supports for the flywheel ring 750.

There is no limitation to the speed at which any of the many types and variations of flywheels operate. For example, any of the flywheels disclosed herein can be operated at any rotational speed in the range of from 2500 rpm to 20000 rpm, or greater. In an embodiment, cupped flywheel 702 can be operated at a rotational speed of from less than 2500 rpm to 20000 rpm, or greater. For example, cupped flywheel 702 can be operated at a rotational speed of 1000 rpm, 2500 rpm, 5000 rpm, 5600 rpm, 7500 rpm, 8000 rpm, 9000 rpm, 10000 rpm, 12000 rpm, 12500 rpm, 13000 rpm, 14000 rpm, 15000 rpm, 17500 rpm, 18000 rpm, 20000 rpm, 25000 rpm, 30000 rpm, 32000 rpm, or greater.

There is also no limitation to the angular velocity at which any of the many types and variations of flywheels operate. For example, any of the flywheels disclosed herein can be operated at any rotational speed in the range of from 250 rads/s to 3000 rads/s, or greater. In an embodiment, the cupped flywheel 702 can be operated at a rotational speed of from less than 250 rads/s to 3000 rads/s, or greater. For example, the cupped flywheel 702 can be operated at a rotational speed of 200 rads/s, 300 rads/s, 400 rads/s, 500 rads/s, 600 rads/s, 700 rads/s, 800 rads/s, 900 rads/s, 1000 rads/s, 1200 rads/s, 13000 rads/s, 1400 rads/s, 1500 rads/s, 1600 rads/s, 1750 rads/s, 2000 rads/s, 2200 rads/s, 2500 rads/s, 3000 rads/s, or greater.

There is also no limitation to the velocity of a flywheel portion and/or a portion of the contact surface 715 at which any of the many types and variations of flywheels operate. For example, any of the flywheels disclosed herein can be operated such that the velocity of a flywheel portion and/or a portion of contact surface 715 is in a range of from less than 5 ft/s to 400 ft/s, or greater. For example cupped flywheel 702 can be operated such that velocity of a flywheel portion and/or a portion of contact surface 715 is 2.5 ft/s, 5 ft/s, 7.5 ft/s, 9 ft/s, 10 ft/s, 15 ft/s, 20 ft/s, 25 ft/s, 30 ft/s, 50 ft/s, 75 ft/s, 90 ft/s, 100 ft/s, 125 ft/s, 150 ft/s, 175 ft/s, 190 ft/s, 200 ft/s, 250 ft/s, 300 ft/s, 350 ft/s, 400 ft/s, or greater.

There is no limitation to the mass which any of the many types and variations of flywheels disclosed herein can have. For example, any of the flywheels disclosed herein can have a mass in a range of from less than 1 oz to greater than 50 oz. For example the cupped flywheel 702 can have a mass of less than 0.5 oz, 1.0 oz, 0.75 oz, 1 oz, 2 oz, 3 oz, 4 oz, 5 oz, 7.5 oz, 9 oz, 10 oz, 12 oz, 14 16 oz, 18 oz, 20 oz, 25 oz, 30 oz, 40 oz, 50 oz, or greater. In another example, the cupped flywheel 702 can have a mass of less than 10 g, 25 g, 28 g, 50 g, 75 g, 100 g, 150 g, 200 g, 250 g, 300 g, 500 g, 750 g, 900 g, 1000 g, 1250 g, 1500 g, 2000 g, or greater.

There is no limitation to the inertia of any of the many types and variations of flywheels. For example, any of the flywheels disclosed herein can be operated to have any inertia in the range of from less than 10 J(kg*m^2) to 500 J(kg*m^2), or greater. For example cupped flywheel 702 can have an inertia of less than 5 J(kg*m^2), 7.5 J(kg*m^2), 10 J(kg*m^2), 25 J(kg*m^2), 50 J(kg*m^2), 75 J(kg*m^2), 90 J(kg*m^2), 100 J(kg*m^2), 150 J(kg*m^2), J(kg*m^2), 200 J(kg*m^2), 250 J(kg*m^2), 300 J(kg*m^2), 350 J(kg*m^2), 400 J(kg*m^2), 450 J(kg*m^2), 500 J(kg*m^2), 600 J(kg*m^2), or greater.

There is also no limitation regarding the flywheel energy which any of the many types and variations of flywheels can possess. For example, any of the flywheels disclosed herein can have a flywheel energy of any value in the range of from less than 10 j to 1500 j, or greater. For example cupped flywheel 702 can have a flywheel energy of less than 5 j, 10 j, 20 j, 50 j, 100 j, 150 j, 200 j, 250 j, 300 j, 350 j, 400 j, 450 j, 500 j, 550 j, 600 j, 650 j, 700 j, 750 j, 800 j, 900 j, 1000 j, 1100 j, 1250 j, 1500 j, 2000 j, or greater.

Figure 12A:
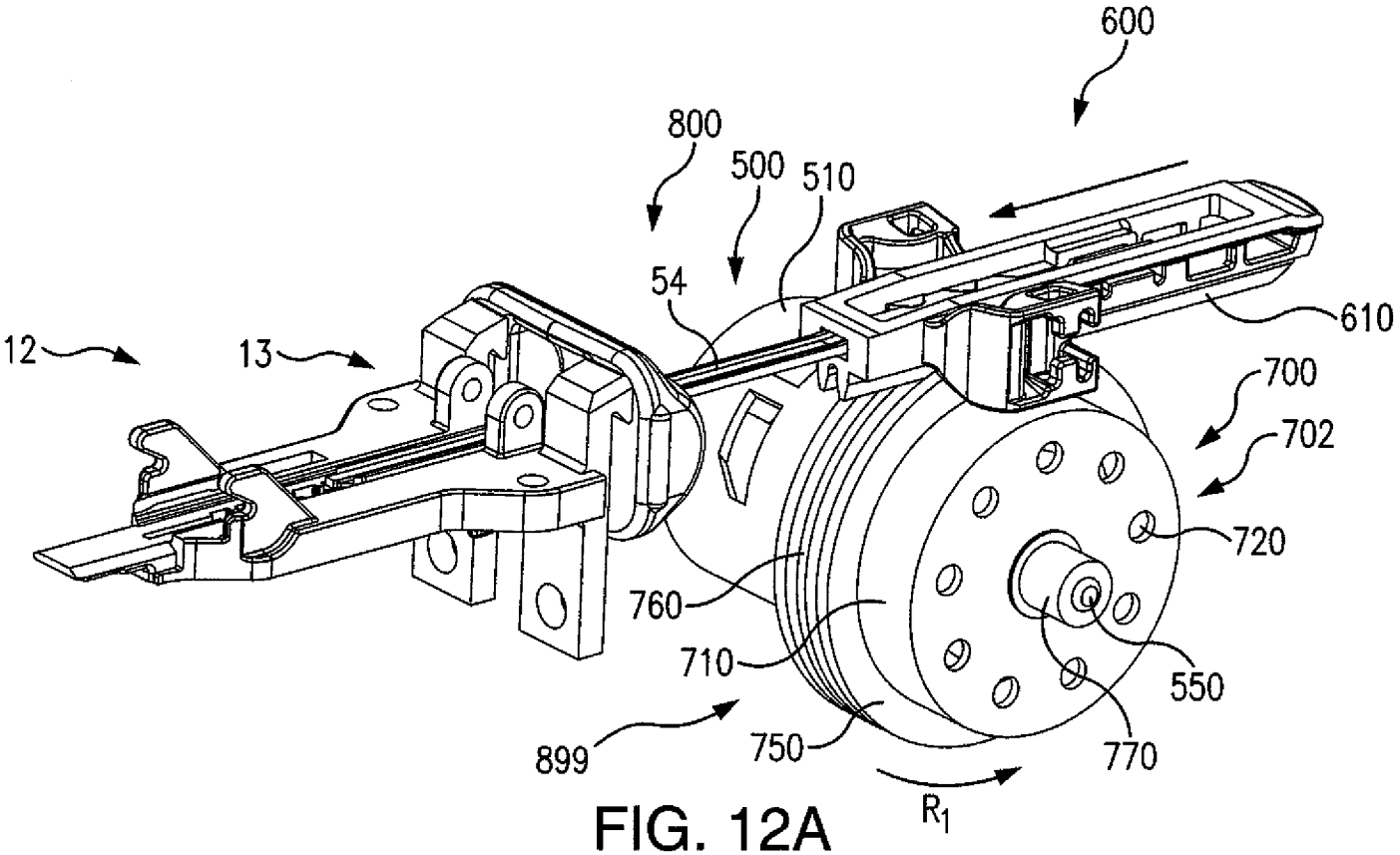
FIG. 12A is a perspective view of the drive mechanism having the cupped flywheel and the driver which is in an engaged state.

FIG. 12A is a side view of a drive mechanism having the cupped flywheel 702 and a driver profile 610 which is in an engaged state. In FIG. 12A, the driving process is shown at a point of the sequence in which the driver profile 610 is frictionally engaged with the cupped flywheel 702. At this stage the cupped flywheel 702 will impart energy to the driver profile 610 which bears the driver blade 54. This energy will propel the driver profile toward the nosepiece 12, which in the example of FIG. 12A is the latched nosepiece 13.

There is no limitation to the driving force which can be imparted to the driver profile 610 and/or the driver blade 54. For example, any of the flywheels disclosed herein can impart a driving force in a range of from less than 2 j to 1000 j, or greater. For example cupped flywheel 702 can impart a driving force to the driver profile 610 and/or the driver blade 54 of less than 1 j, 2 j, 4 j, 8 j, 10 j, 15 j, 20 j, 25 j, 50 j, 75 j, 90 j, 100 j, 125 j, 150 j, 175 j, 200 j, 250 j, 300 j, 350 j, 400 j, 500 j, 1000 j, 15000 j, or greater.

There is no limitation to the torque generated by the inner rotor motor 500. For example, any of the flywheels disclosed herein can be driven by the inner rotor motor 500 which can generate a torque in the range of from less than 0.005 Nm to 10 Nm, or greater. For example, the inner rotor motor 500 can generate any torque in the range of from less than 0.005 Nm, 0.01 Nm, 0.05 Nm, 0.075 Nm, 0.09 Nm, 0.1 Nm, 1.5 Nm, 2 Nm, 2.5 Nm, 3 Nm, 3.5 Nm, 4 Nm, 4.5 Nm, 5 Nm, 6 Nm, 7 Nm, 10 Nm, or greater.

There is no limitation to the velocity of the driver profile 610 at which any of the many types and variations of flywheels operate. For example, any of the driver profile 610 disclosed herein can be operated at any velocity in the range of from less than 10 ft/s to 400 ft/s, or greater. For a power tool and/or fastening device having the cupped flywheel 702 can have the driver profile 610 which can have a velocity of for example, 2.5 ft/s, 5 ft/s, 7.5 ft/s, 9 ft/s, 15 ft/s, 20 ft/s, 25 ft/s, 30 ft/s, 50 ft/s, 75 ft/s, 90 ft/s, 100 ft/s, 125 ft/s, 150 ft/s, 175 ft/s, 190 ft/s, 200 ft/s, 250 ft/s, 300 ft/s, 350 ft/s, 400 ft/s, or greater.

Figure 12B:
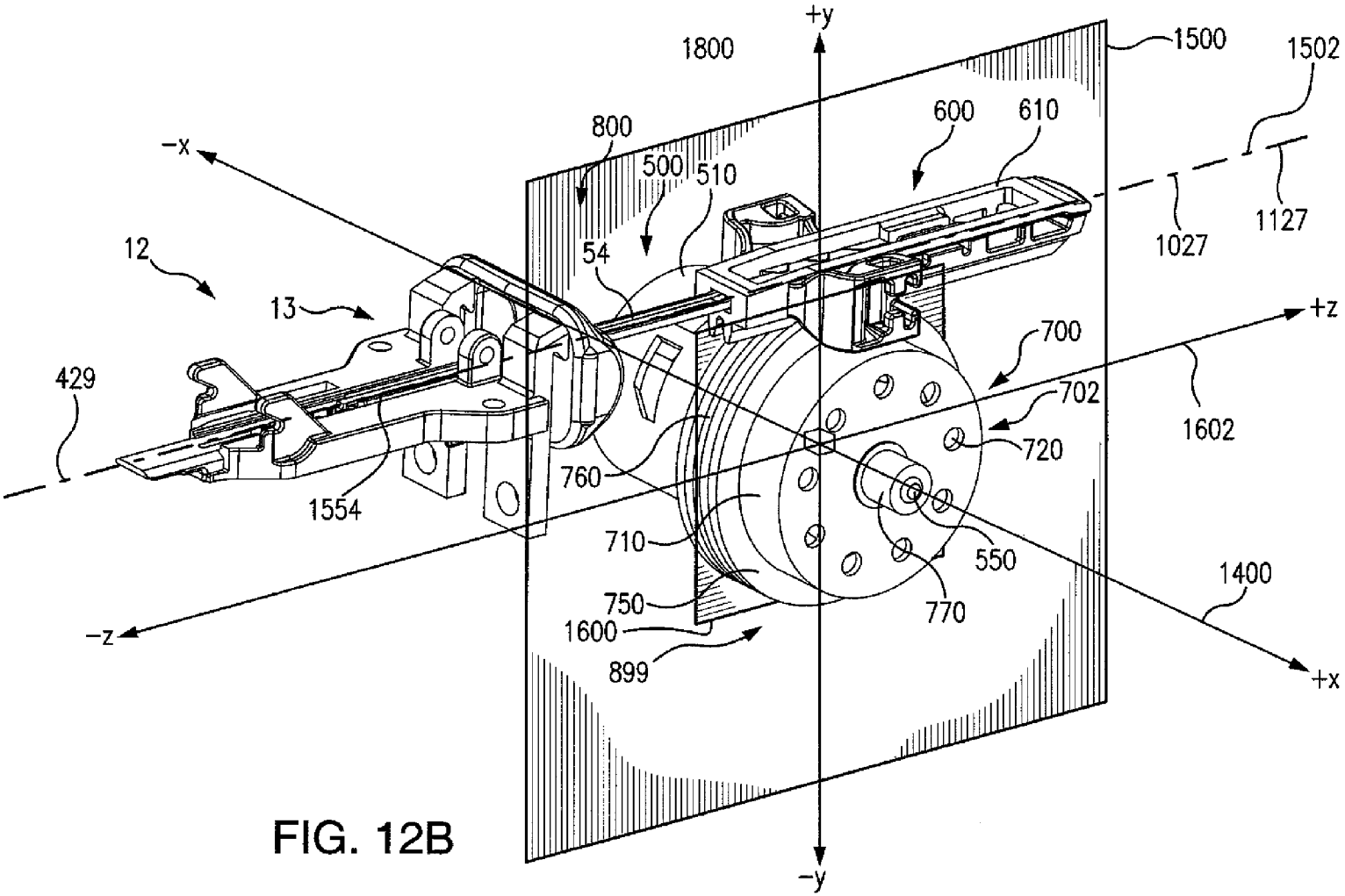
FIG. 12B is a perspective view of the drive mechanism having the cupped flywheel and the driver which is in an engaged state showing an embodiment in which a flywheel ring centerline plane in coplanar with a driver centerline plane.

FIG. 12B is a side view of a drive mechanism having the cupped flywheel and a driver which are in an engaged state and shows an embodiment in which the flywheel ring centerline plane 1600 is coplanar with the driver centerline plane 1500. FIG. 12B provides a detailed illustration of the geometry of the example embodiment disclosed in FIG. 12A. In an embodiment, a cantilevered flywheel member such as the flywheel ring 750 can be positioned along its rotational plane to have a flywheel ring center line plane 1600 coplanar to a driver centerline plane 1500. There is no limitation to the geometries and configurations which can be used to coordinate a portion of the flywheel 700 to contact the driver profile 610. In the embodiment shown in FIG. 12A, the cupped flywheel 702 has a cantilevered position of a portion of cupped flywheel body 710 and flywheel ring 750 such that they are projected over at least a portion of the inner rotor motor 500.

In the example of FIG. 12B, the alignment of the flywheel ring center line plane 1600 coplanar to the driver centerline plane 1500 can further be positioned coplanar to a plane extending from the channel centerline 429 shown in FIG. 6. In the embodiment of FIG. 12B, the radial centerline 1602 of the flywheel ring 750, the driver profile centerline 1502, driver blade centerline 1554 and the channel centerline 429 can be coplanar.

In an embodiment, the radial centerline 1602 of the flywheel ring 750 and the centerline of the driver profile centerline 1502 can be parallel. In an embodiment, the radial centerline 1602 of the flywheel ring 750 and the centerline of the channel centerline 429 can be parallel. In an embodiment, the driver profile centerline 1502 and the channel centerline 429 can be parallel. In an embodiment, the driver profile centerline 1502 and the driver blade centerline 1554 can be parallel. In an embodiment, the driver profile centerline 1502 and driver blade centerline 1554 can be collinear. In an embodiment, the driver profile centerline 1502, the driver blade centerline 1554 and the channel centerline 429 can be collinear.

There is no limitation to the geometries that can be used regarding the coordination of the components of the drive mechanism disclosed herein. In another embodiment, the driver blade centerline 1554 can be coplanar with the flywheel ring centerline plane 1600. This allows for many configurations of the driver blade 54 and flywheel 700 to achieve a successful driving of the driver blade 54. In another embodiment, the driver profile centerline 1502 can be coplanar with the flywheel ring center line plane 1600. Many configurations of the driver profile 610 and flywheel 700 can achieve a successful driving of the driver profile 610. In another embodiment, the channel centerline 429 can be coplanar with the flywheel ring center line plane 1600. Many configurations of the channel 52 and flywheel 700 can achieve a successful driving of a nail 53.

While the embodiment of FIG. 12B shows the radial centerline 1602 of the flywheel ring 750 and the driver profile centerline 1502 in a coplanar arrangement, arrangements which are not coplanar can also be used. For example, configurations can be used in which the driver blade centerline 1554 is not coplanar with the radial centerline 1602 of the flywheel ring 750. In other examples, configurations can be used in which the radial centerline 1602 of the flywheel ring 750 and the channel centerline 429 are not coplanar. In another embodiment, the driver blade centerline 1554 is not collinear with the driver profile centerline 1502.

There is also no limitation to an angle of contact which generates friction and/or otherwise transfers energy between the flywheel 700 and the driver profile 610 and/or driver blade 54. FIG. 12B illustrates a tangential contact between a portion of the driver profile 610 and the flywheel ring 750. Any angle sufficient to allow a transfer of energy from the flywheel 700 to the driver profile 610 and/or directly to the driver blade 54 can be used. For example, a contact between the flywheel 700 can be configured such that the flywheel ring centerline plane 1600 intersects the driver centerline plane 1500 at an angle, such as at an angle less than 90°, or less than 67°, or less than 45°, or less than 34°, or less than 25°, or less than 18°, or less than 15°, or less than 10°, or less than 5°, or less than 3°.

Figure 13:
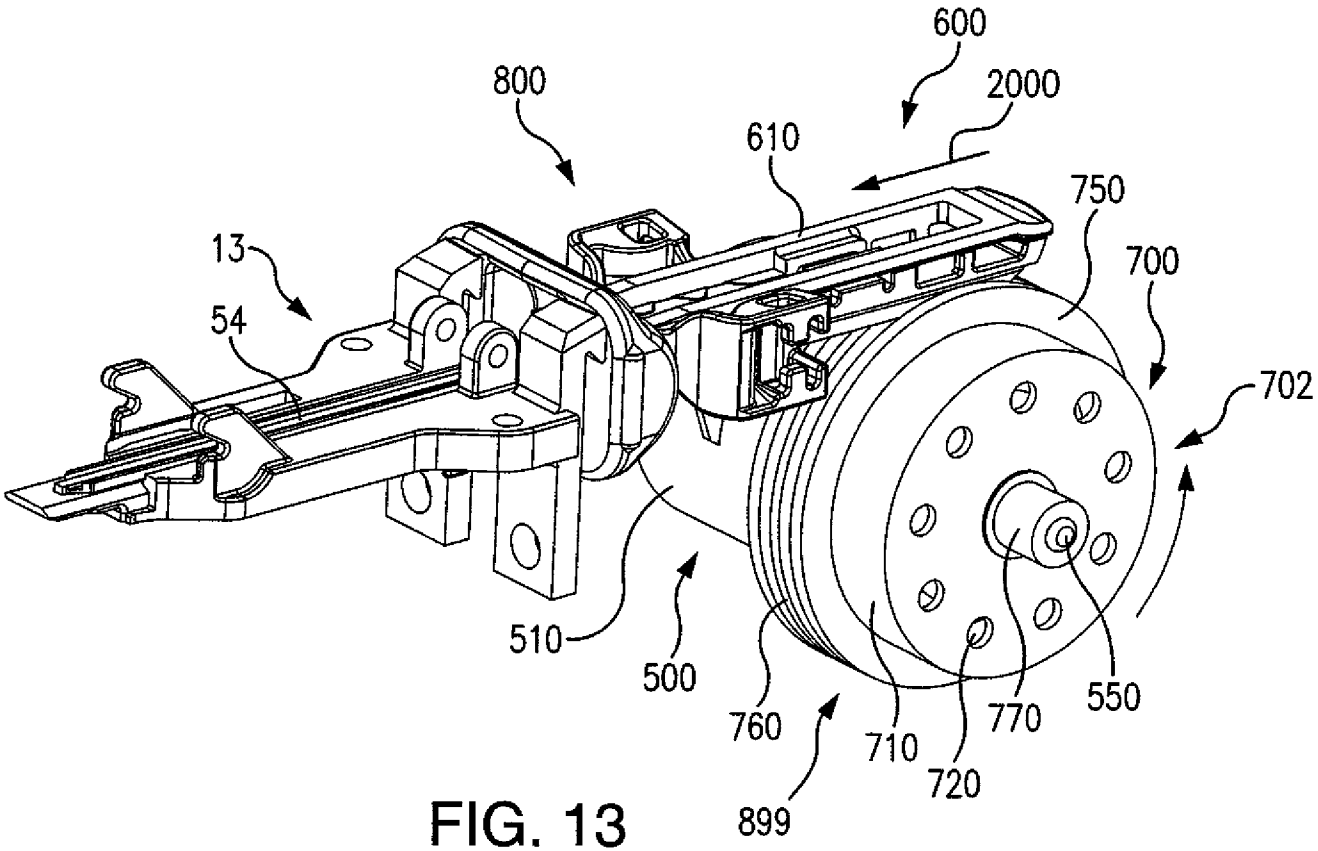
FIG. 13 is a perspective view of a drive mechanism having the cupped flywheel and the driver which is in a driven state.

FIG. 13 is a side view of a drive mechanism having the cupped flywheel and a driver profile 610 which has progressed in its driving action to a position striking a fastener. FIG. 13 illustrates the driver profile 610 at a position in which is still engaged with the flywheel ring 750, yet is near the end of its driving motion which terminates when the driver profiles motion toward the nosepiece assembly 12 ceases and the motion of profile 610 toward the nosepiece 12 stops and/or when recoil begins of the driver profile 610 back toward its original configuration as show in FIG. 11. Arrow 2000 indicates the direction of motion of the driver profile 610 during a driving action.

Figure 14:
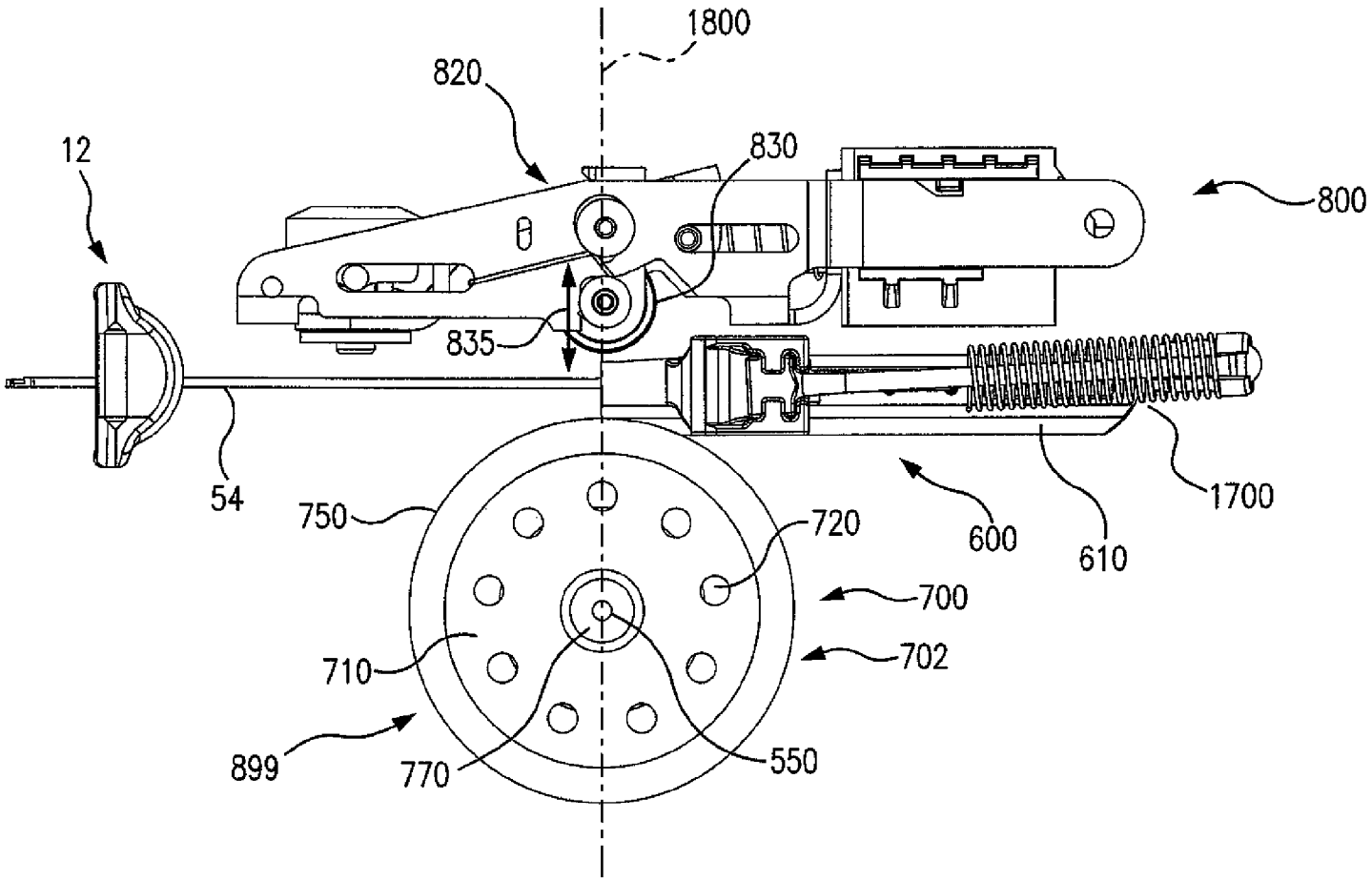
FIG. 14 is a side view of a partial drive assembly having the cupped flywheel.

FIG. 14 is a side view of a drive assembly having the cupped flywheel 702. FIG. 14 shows an example embodiment of a nailer drive mechanism at the state in which the driver profile 610 has initially and tangentially made frictional contact with the flywheel ring 750. This is a position analogous to that depicted in FIG. 12. FIG. 14 illustrates an embodiment of the driver assembly 800 including an activation mechanism 820 which has an activation member 830 which by its movement can impart a force along the engagement axis 1800 (also illustrated in FIG. 12B as a +y and −y axis) which causes the driver profile 610 to come into frictional contact with flywheel 700 to effect a driving motion of driver profile 610. The engagement movement of activation member 830 is reversible and illustrated by a double pointed engagement movement arrow 835. FIG. 14 also illustrates an embodiment of a driver profile return mechanism 1700 which absorbs recoil energy and guides the driver profile 610 back to its resting state, prior to another driving action.

Figure 15:
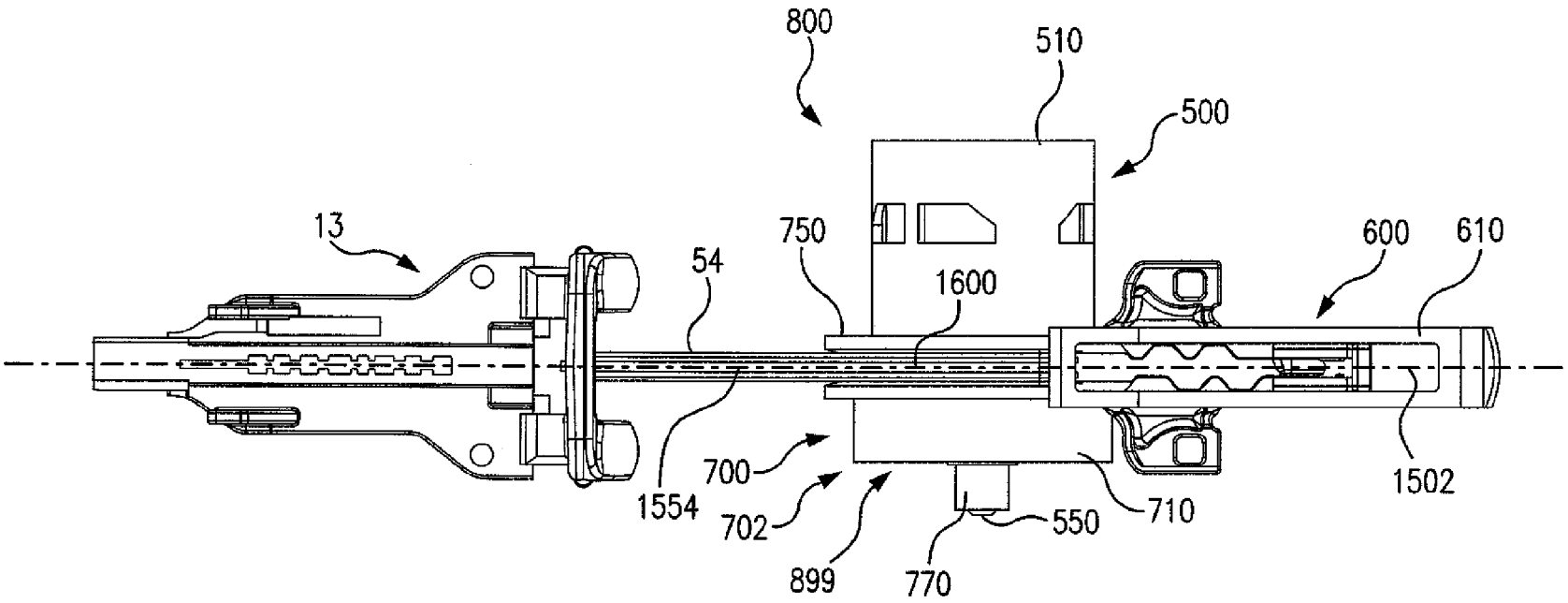
FIG. 15 is a top view of the partial drive assembly having the cupped flywheel.

FIG. 15 is a top view of a partial drive assembly having the cupped flywheel. FIG. 15 shows the driver profile 610 at a resting state. FIG. 15 also illustrates the parallel and/or coplanar configuration of driver profile centerline 1502, the flywheel ring centerline plane 1600 and the driver blade centerline 1554.

Figure 16A:
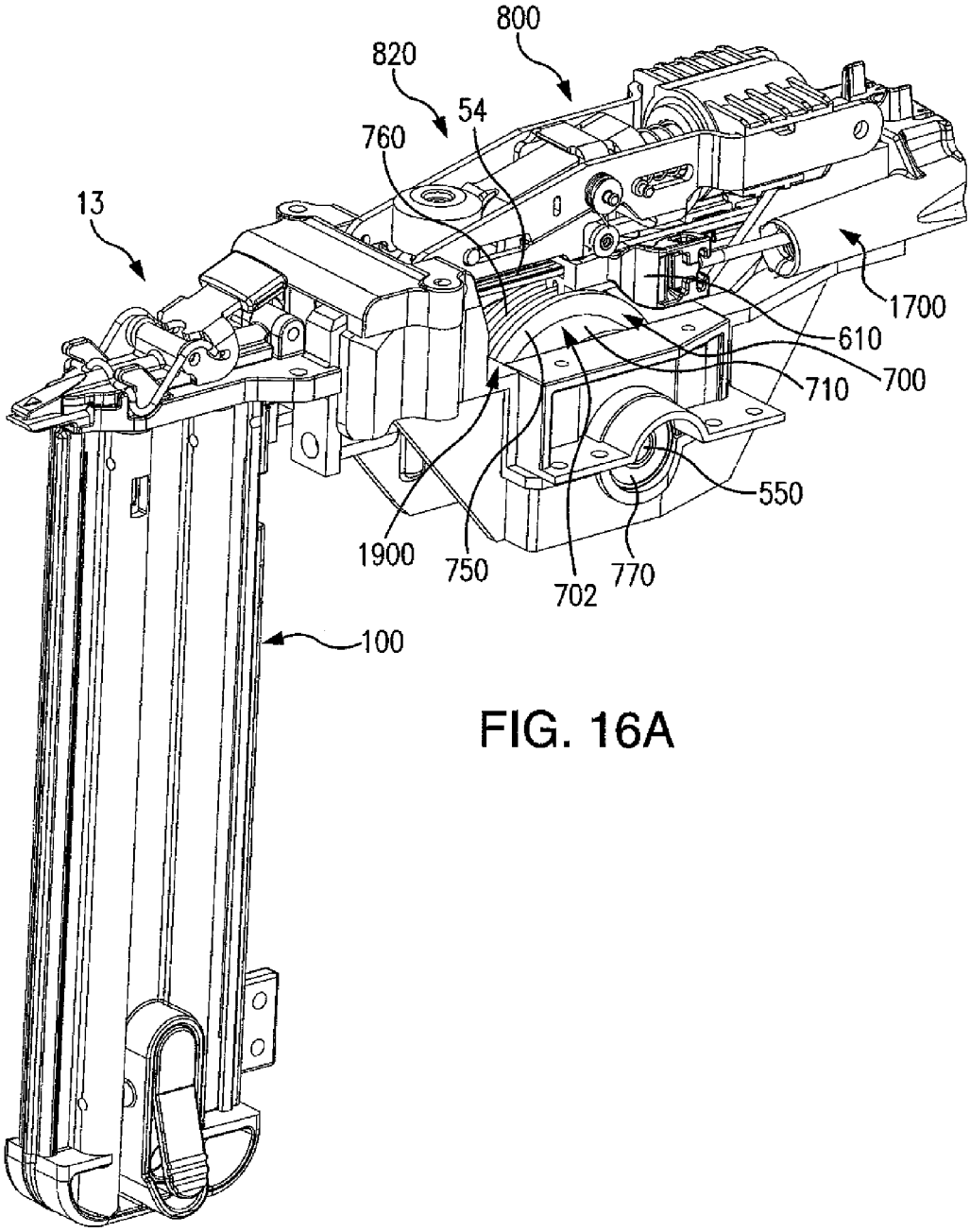
FIG. 16A is a perspective view of the drive assembly having the cupped flywheel shown in conjunction with a magazine for nails.

FIG. 16A is a perspective view of a drive assembly having the cupped flywheel 702 shown in conjunction with the magazine 100 feeding the plurality of nails 55. FIG. 16A illustrates a driver assembly 800 in conjunction with the driver profile 610 and cantilevered drive 1900. The cantilevered drive can have an inner rotor motor 500 and the cupped flywheel 702, as well as a geared flywheel ring 760 which can frictionally engage the driver profile 610 when activated by the activation mechanism 820. In this example embodiment, the power tool is a nailer 1 having the latched nosepiece assembly 13 and a magazine 100 feeding a plurality of nails 55.

Figure 16B:
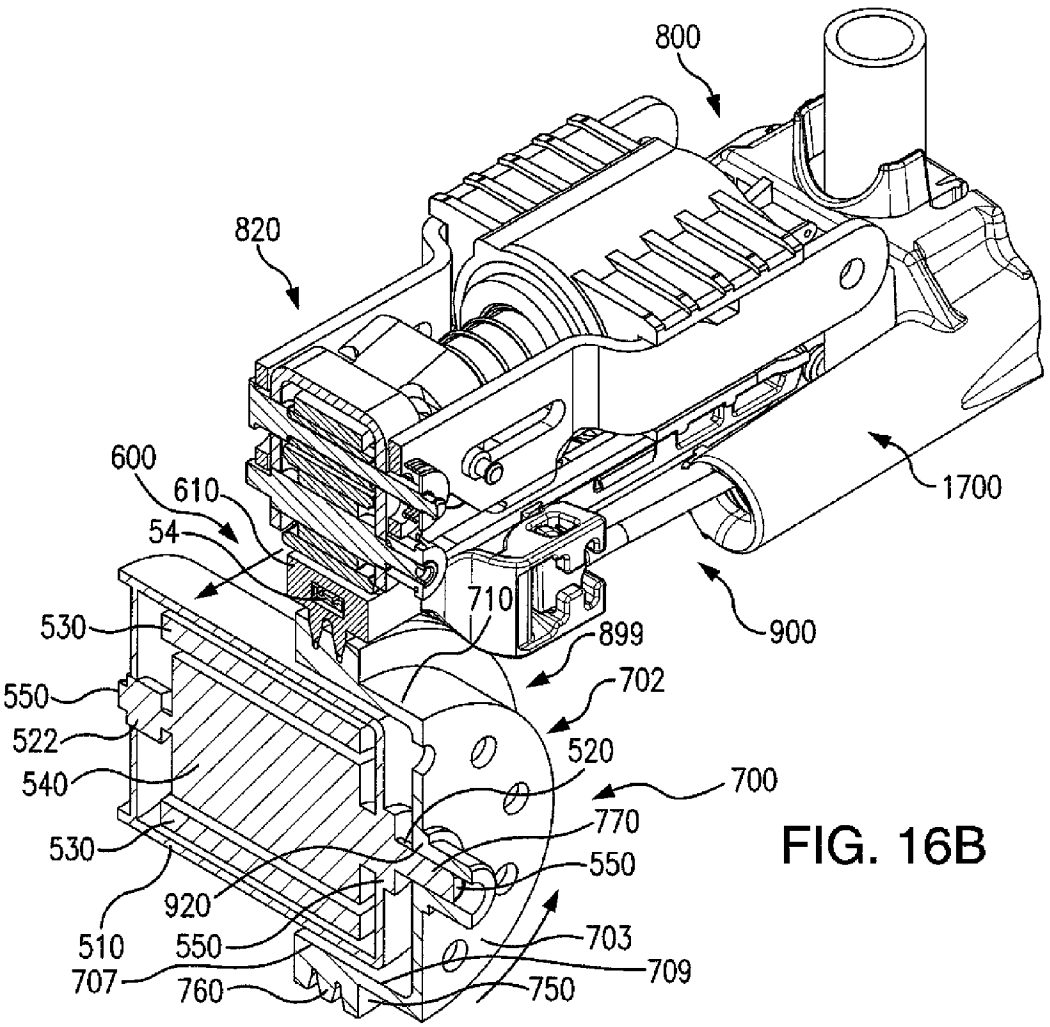
FIG. 16B is a sectional view of the drive assembly having the cupped flywheel taken along the longitudinal centerline plane of the rotor shaft.

FIG. 16B is a sectional view of the drive assembly shown in FIG. 16 having the cupped flywheel sectioned along the longitudinal centerline plane of the rotor shaft. FIG. 16 illustrates a cross section of the activation mechanism 820 and driver profile 610 bearing driver blade 54. In this embodiment, the driver profile 610 is engaged by the flywheel ring 750. The cupped flywheel 702, the flywheel ring 750, the inner rotor motor 500, the rotor shaft 550 and flywheel bearing 770 are shown in cross section. FIG. 16B also illustrates a bearing support ring 920 which in the cross section is shown as a ring of extra material having a thickness provided to strengthen the transition of shape (the approximate 90 degree angle) between the flywheel bearing 770 longitudinal axis and the plane of the flywheel face 703. The bearing support ring 920 can be of a single body construction strengthening the transition of material between the bearing 770 and flywheel face 703.

Figure 17:
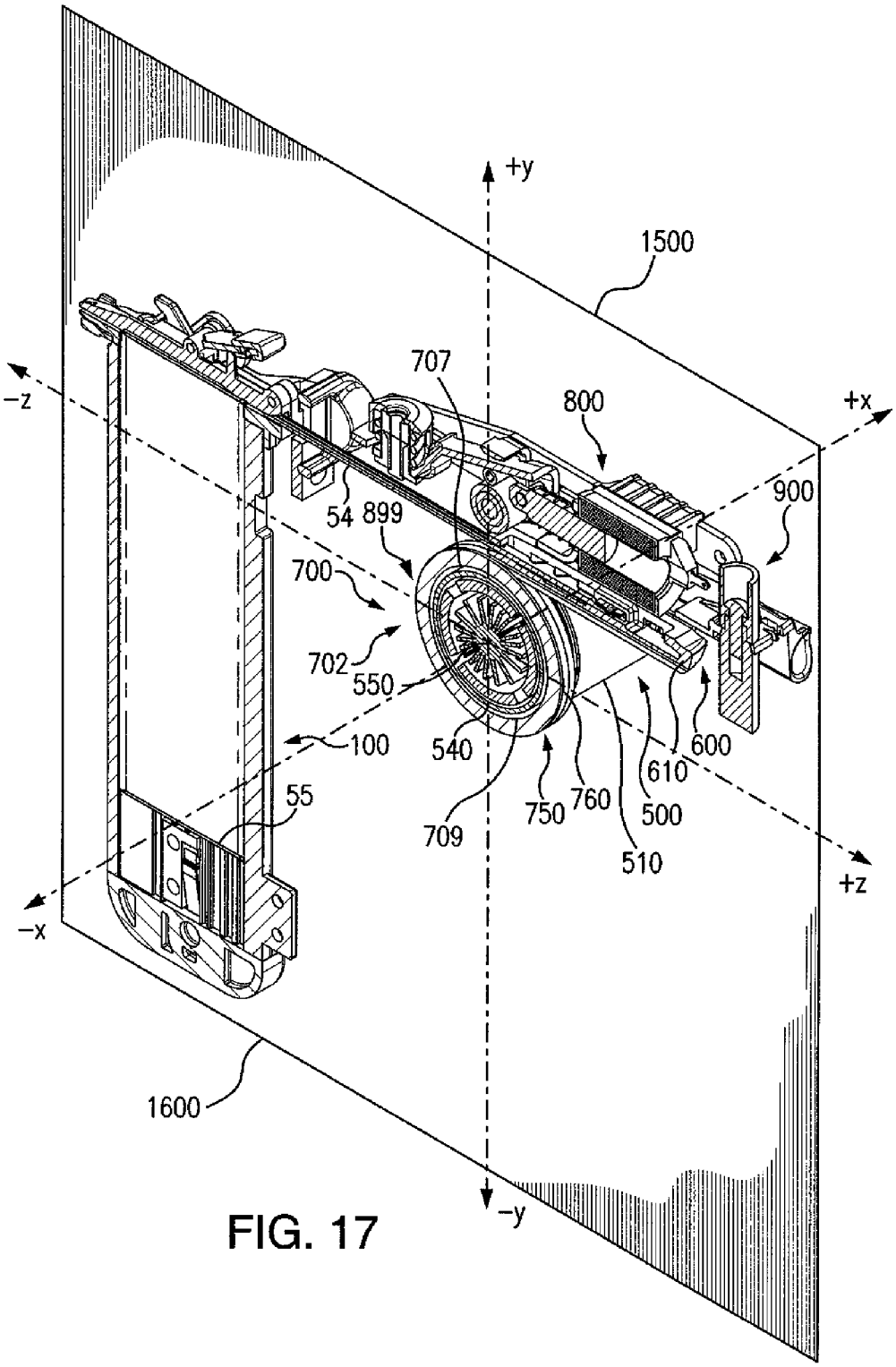
FIG. 17 is a sectional view of the drive assembly having the cupped flywheel taken along the longitudinal centerline plan of the driver profile.

FIG. 17 is a sectional view of a drive assembly having the cupped flywheel 702 taken along the driver centerline plane 1500 of the driver profile. FIG. 17 is a sectional view of the driver assembly 800 example of FIG. 16A, which in FIG. 17 is shown in a cross sectional view taken along the flywheel ring centerline plane 1600. In the example of FIG. 17, the driver centerline plane 1500 and the flywheel ring centerline plane 1600 are shown in a coplanar configuration. FIG. 17 illustrates an example of the alignment of the flywheel ring 750, the driver profile 610 and the driver blade 54 in conjunction with the activation mechanism 820. The stator 530 and inner rotor 540 of inner rotor motor 500 are shown in cross section.

FIGS. 18A-G show a variety of embodiments of cantilevered flywheel designs. There is no limitation to the design of the cantilevered flywheels or regarding the means of supporting such flywheels or transferring their energy to a moveable member, such as the driver profile 610. The various cantilevered flywheel designs can have contact surface 715, as shown in non-limiting example in FIGS. 18A, 20, 21, 22 and 23. The contact surface 715 can be any portion of the flywheel which contacts another member and which imparts energy to another member.

The contact surface 715 in its many types and variations can impart energy to the driver profile 610 and/or driver blade 54. The interface between the contact surface 715 and the driver profile 610 and/or driver blade 54 can have a breadth of variety. For example, the interface can produce a frictional contact (e.g. FIG. 20) or a geared contact (e.g. FIGS. 10A, 10B and 21). The shape of the contact surface 715 can range from flat or flattened, to rough or patterned, to having large gearing. The shape of the contact surface in an axial direction along the −x to +x axis (FIG. 12B) can be any shape in the range of concave to convex. Additionally, the contact surface 715 can have a surface which is sinusoidal, grooved, adapted for a lock and key interface, pitted, nubbed, having depressions, having projections, or any of a variety of topography which can adapt the contact surface 715 to impart energy to another object and/or item, such as the driver profile 610 and/or driver blade 54, or moveable member, gear or other member.

Figure 18A:
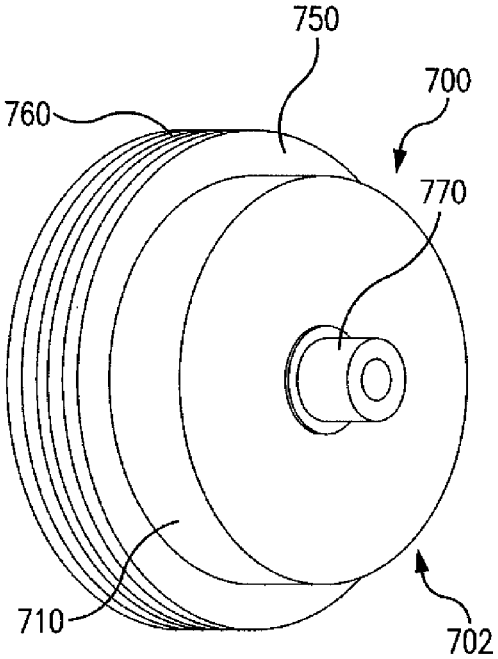
FIG. 18A is a perspective view of the cupped flywheel.
Figure 20:
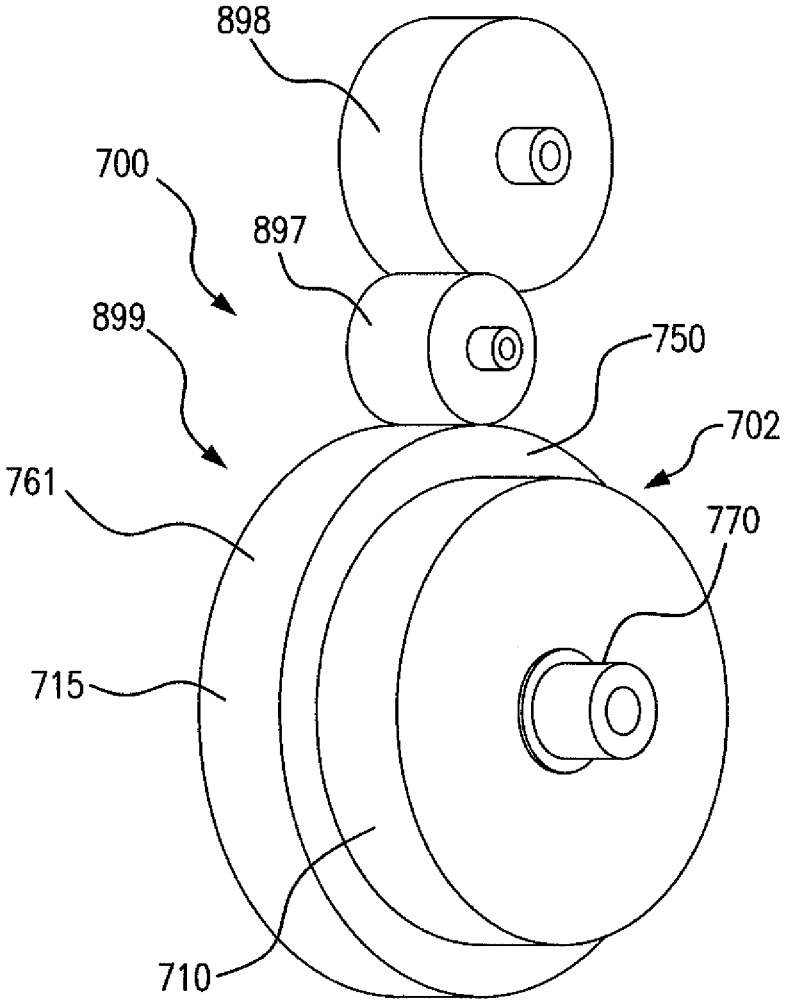
FIG. 20 is an embodiment of a cupped flywheel roller drive mechanism.
Figure 22:
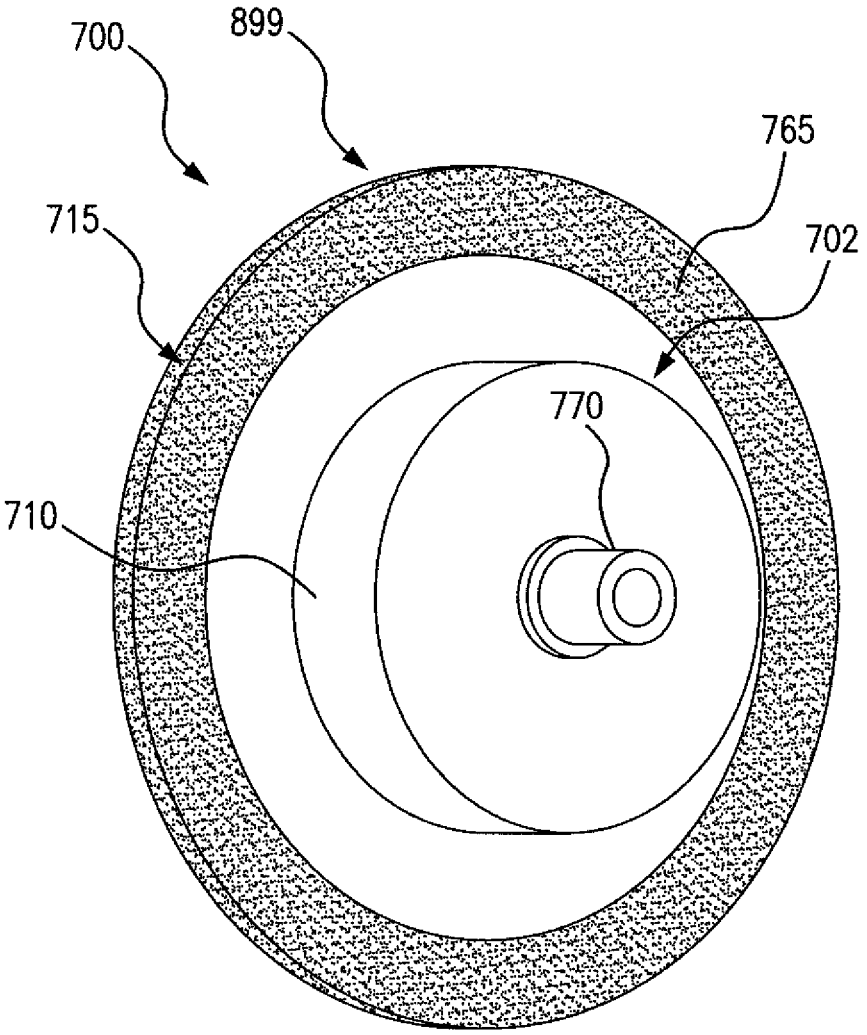
FIG. 22 is an embodiment of the cupped flywheel having a flywheel ring grinder portion.
Figure 23:
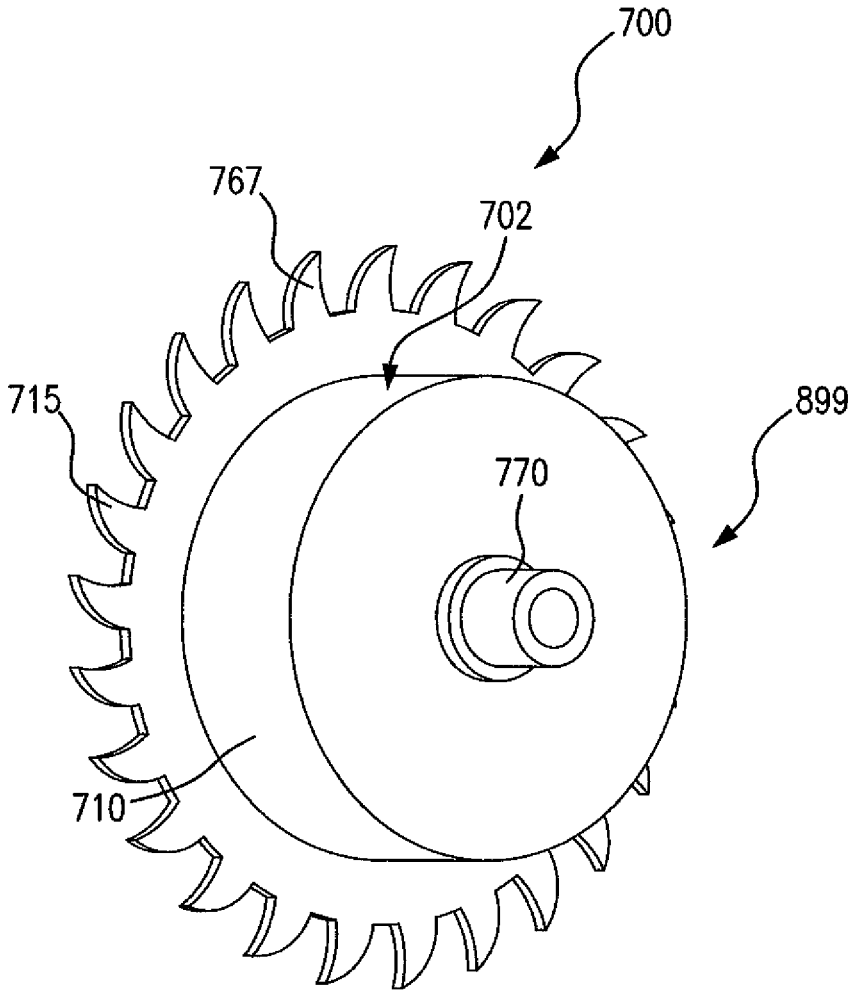
FIG. 23 is an embodiment of the cupped flywheel having a flywheel ring saw portion.

FIG. 18A is a perspective view of the cupped flywheel 702 having the geared flywheel ring 760. In the example of FIG. 18A, the contact surface 715 is shown as a geared surface of the geared flywheel ring 760. In the example of FIG. 20, the contact surface 715 is a flattened surface which can cause another member to rotate or otherwise move. In the example of FIG. 22, the contact surface 715 is a grinding surface of a flywheel ring grinder portion which can remove material from another article. In the example of FIG. 23, the contact surface 715 is a saw tooth portion of flywheel ring saw portion 767. In the many and varied embodiments, the contact surface 715 can be in a position cantilevered to rotate radially about at least a portion of the motor housing 510 and inner rotor motor 500.

Figure 18B:
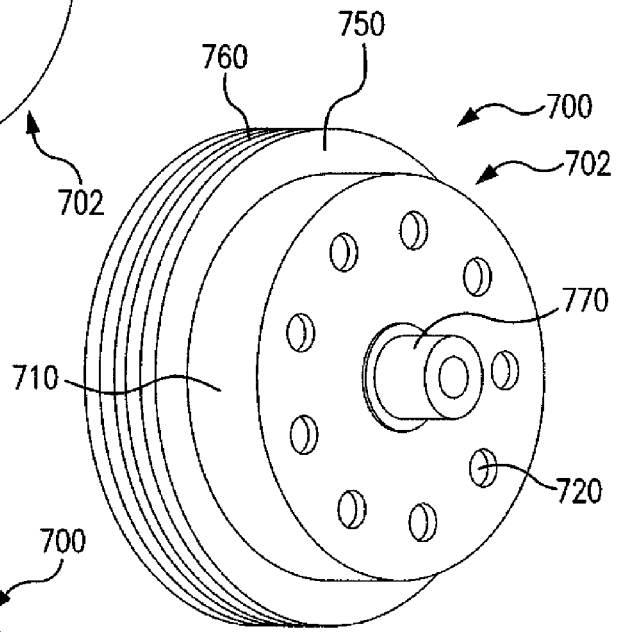
FIG. 18B is a view of the cupped flywheel having a number of flywheel openings in a flywheel face.

FIG. 18B is a view of the cupped flywheel having a number of flywheel openings in the flywheel face. In the example of FIG. 18B, a number of a flywheel openings 720 are present and pass through the flywheel face 703. There is no limitation regarding the shape of the openings which are used with the cupped flywheel 702. If the flywheel cup material is sufficiently thick, grooves or other features which can reduce the weight of the cupped flywheel 702 can be used whether or not an opening is created in any portion of the cupped flywheel 702.

Figure 18C:
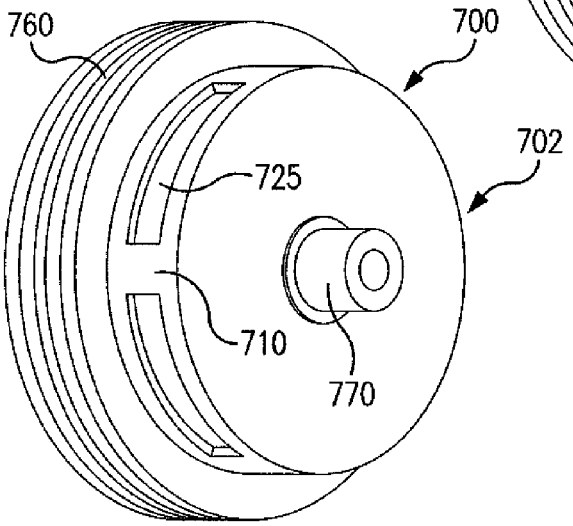
FIG. 18C is a view of the cupped flywheel having a number of flywheel slots in a flywheel body.

FIG. 18C is a view of the cupped flywheel 702 having a number of flywheel slots in a flywheel body 710. The cupped flywheel can have a flywheel slot 725 or a number of flywheel slots. Herein, a number of flywheel slots are also collectively referenced by the numeral 725. FIG. 18C shows the cupped flywheel 702 which has the number of flywheel slots 725 present in the flywheel body 710. The number of the flywheel slots 725 can reduce the weight of the flywheel 700, achieve a desired rotation balance of the flywheel, achieve inertial specifications of the flywheel 700 and meet performance specifications for the flywheel 700. The number of flywheel slots 725 in the cupped flywheel 702 can be used to achieve design benefits, such as weight control and improved performance, analogous to those achieved by using a number of the flywheel openings 720, or openings of other shapes.

Figure 18D:
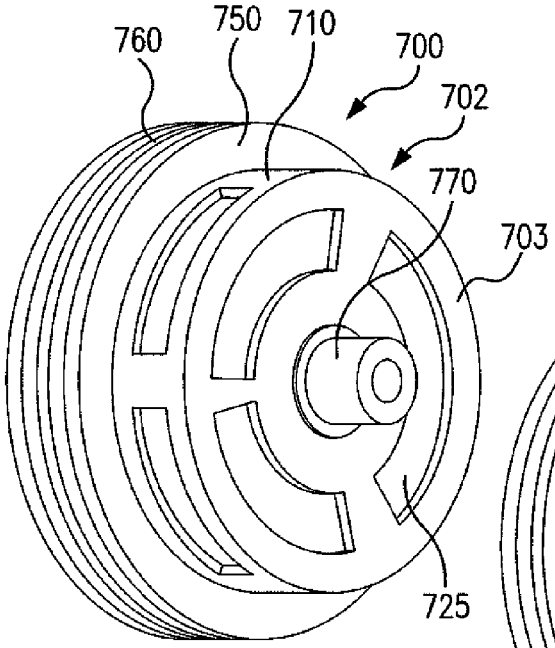
FIG. 18D is a view of the cupped flywheel having a number of flywheel slots in the flywheel body and the flywheel face.

FIG. 18D is a view of the cupped flywheel 702 having the number of slots 725 present in the flywheel body 710 as well as present in the flywheel face 703.

Figure 18E:
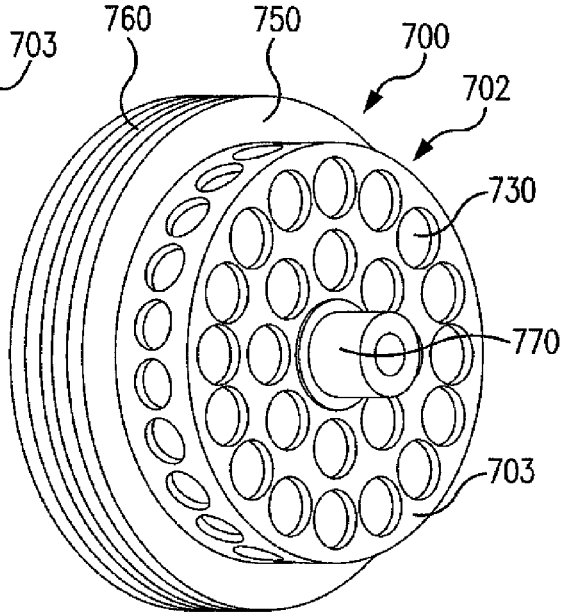
FIG. 18E is a view of the cupped flywheel having a number of flywheel round openings in the flywheel body and the flywheel face.

FIG. 18E is a view of the cupped flywheel having a number of flywheel round openings in a flywheel body 710 and flywheel face 703. In the example of FIG. 18E, the cupped flywheel 702 has a number of a flywheel round openings 730 present in the flywheel body 710, as well as present in the flywheel face 703. While FIG. 18E illustrates an example having a round opening, there is no limitation regarding the shape of the openings that can be used with any variety of the flywheel 700 disclosed herein. For example, openings can be round, oval, oblong, irregular, slots, decoratively shaped, patterned, or any desired shape and/or pattern.

Figure 18F:
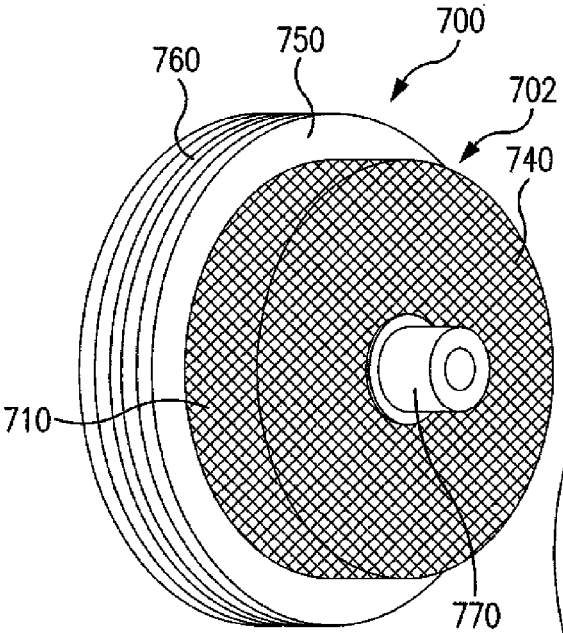
FIG. 18F is a view of the cupped flywheel having a mesh flywheel body and a mesh flywheel face.

FIG. 18F is a view of the cupped flywheel having a mesh flywheel body and mesh flywheel face. There is no limitation as to the nature of the material which supports the contact surface 715 and imparts energy and/or rotational motion from the inner rotor motor 500. Any material which supports the contact surface in a cantilevered position about at least a portion of the inner rotor motor 500 and/or the motor housing 510 can be used. FIG. 18F illustrates an example embodiment in which a flywheel mesh structure 740 is used to support the flywheel ring 750 having a contact surface 715 which is a geared surface.

This disclosure is not limited to a cup-shaped flywheel. The flywheel 700 can be any type of flywheel which supports the contact surface 715 in a cantilevered position about at least a portion of the inner rotor motor 500 and/or the motor housing 510.

Figure 18G:
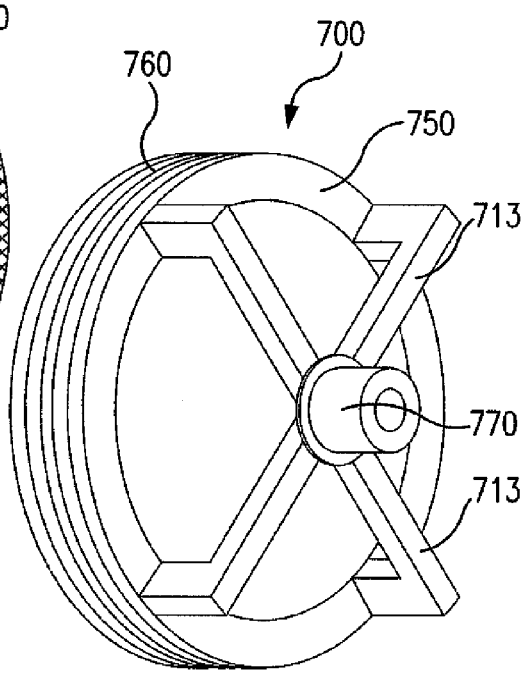
FIG. 18G is a view of a cantilevered flywheel ring supported by a number of flywheel struts.

FIG. 18G is a view of a cantilevered flywheel ring supported by a number of flywheel struts 713. In the example shown in FIG. 18G, the contact surface 715 is the surface of the geared flywheel ring 760. In this embodiment, the geared flywheel ring 760 is supported by a number of flywheel struts 713. In this example, the number of flywheel struts 713 can be coupled to flywheel bearing 770 which can be driven by the rotor shaft 550.

Figure 19A:
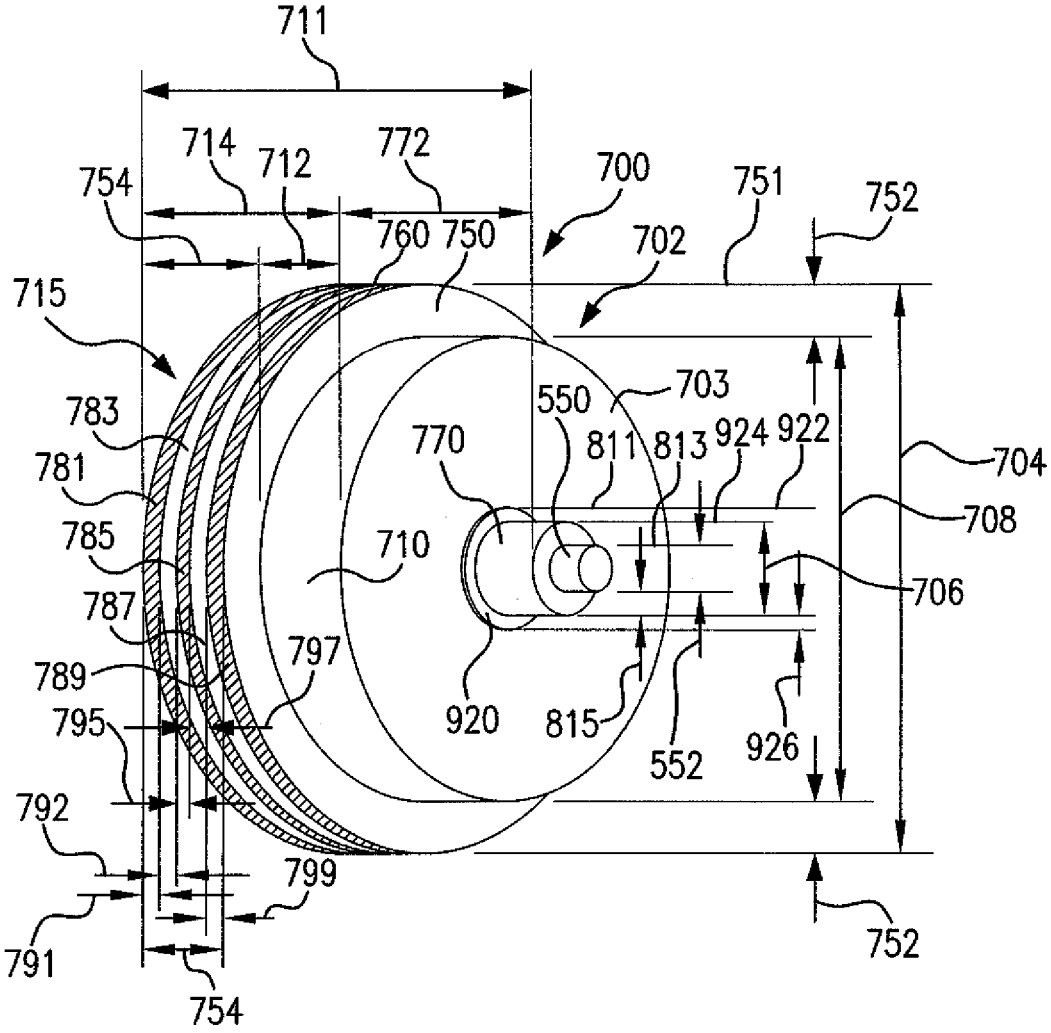
FIG. 19A is a perspective view of the cupped flywheel having dimensioning.

There is no limitation regarding the relative geometries of the features of the cupped flywheel 702. FIG. 19A is a perspective view of the cupped flywheel having dimensions. The example embodiment of FIG. 19 illustrates the flywheel 700 which is the cupped flywheel 702 having a flywheel outer diameter 704 and a flywheel inner diameter 706. The cupped flywheel 702 is born by the flywheel bearing 770 having a flywheel bearing length 772 and a flywheel bearing thickness 815. In an embodiment, a bearing support ring 920 having a bearing support ring width 926 of material can be used to transition the flywheel face 703 material and the flywheel bearing 770 between a bearing support ring outer diameter 811 (also shown as support outer diameter 922) and the flywheel inner diameter 706. As shown in FIG. 19A, the bearing support ring 920 and the flywheel bearing 770 can be supported by material at an interfacing portion which can be of one body in construction and which can extend between the bearing support ring inner diameter 924 and bearing support ring outer diameter 811. The flywheel bearing 770 can be coupled to rotor shaft 550 at an interface between flywheel bearing inner diameter 813 and rotor shaft 550 having a rotor outer diameter 552. The cupped flywheel 702 can have a flywheel body outside diameter 708 from which a flywheel ring can extend radially in a direction away from the rotor shaft 550 and have a flywheel ring height 752 as measured in FIG. 19A between the flywheel outer diameter 704 and the flywheel body outside diameter 708. The flywheel ring 750 can also have an outer diameter 751.

The cupped flywheel 702 can have a flywheel length 711 which in projection can be composed of a flywheel ring length 754, a flywheel body length 712 of flywheel body 710 and a flywheel bearing length 772. A flywheel cup length 714 can have a length which in its projection can be composed of the flywheel ring length 754 and the flywheel body length 712. Optionally, the flywheel bearing can be flat with the flywheel face 703, not have a projection and not contribute to the flywheel length 711. In other embodiments, the flywheel bearing is not used and has no contribution to the flywheel length 711.

FIG. 19A illustrates the cupped flywheel 702 having the flywheel ring 750 which has the contact surface 715 which is grooved and/or geared forming the geared flywheel ring 760. There is no limitation to the type of gearing, grooving or surface characteristics of the contact surface 715. In the embodiment of FIG. 19A, the geared flywheel ring 760 has flywheel ring length 754 and a number of gear teeth. As shown in FIG. 19A, the geared flywheel ring 760 has a first gear tooth 781 having first gear tooth width 791, a second gear tooth 785 having second gear tooth width 795, and a third gear tooth 789 having third gear tooth width 799. The first gear tooth 781 can be separated from the second gear tooth 785 by a first gear groove 783 having first gear groove width 792. The second gear tooth 785 can be separated from the third gear tooth 789 by a second gear groove 787 having second gear groove width 797.

Figure 19B:
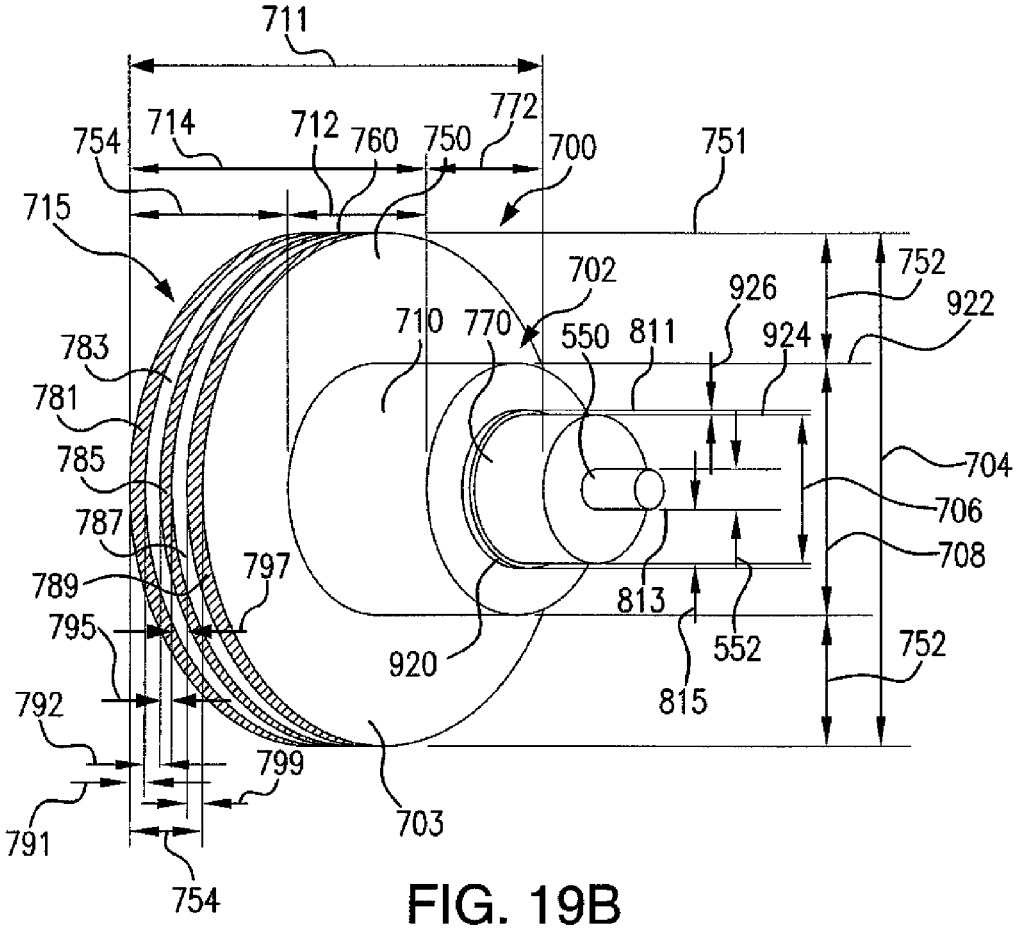
FIG. 19B is an example of the cupped flywheel having a narrow cup and wide flywheel ring.

FIG. 19B is an example of cupped flywheel having a narrow cup and wide flywheel ring. FIG. 19B is an example of another dimensional configuration of the cupped flywheel 702 having the flywheel ring 750. In the embodiment of 19B the flywheel body outside diameter 708 is less than that of the embodiment illustrated in FIG. 19A and the flywheel ring height 752 is greater than that of the embodiment illustrated in FIG. 19A. Any dimension of the flywheel 700 and the cupped flywheel 702 can be set to meet any design specifications.

Figure 21:
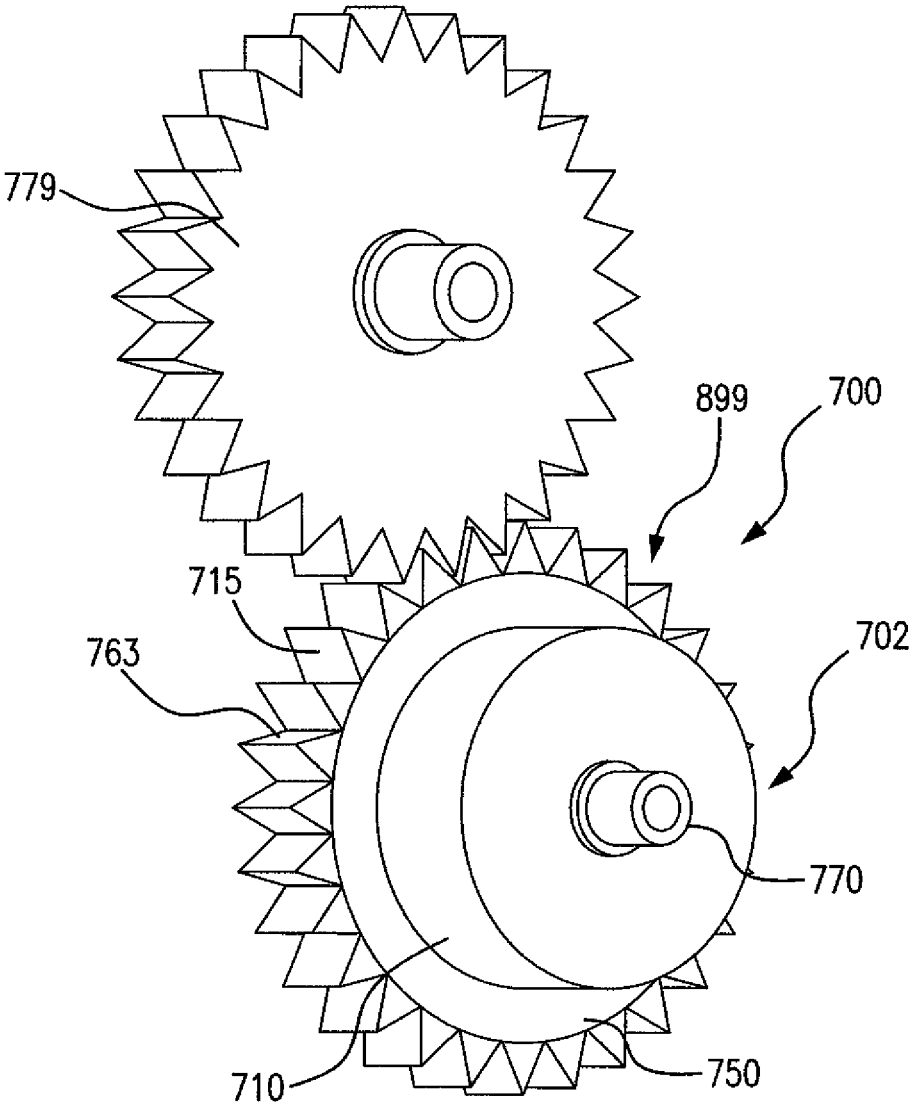
FIG. 21 is an embodiment of the cupped flywheel having a flywheel ring having axial gears.
Figure 24:
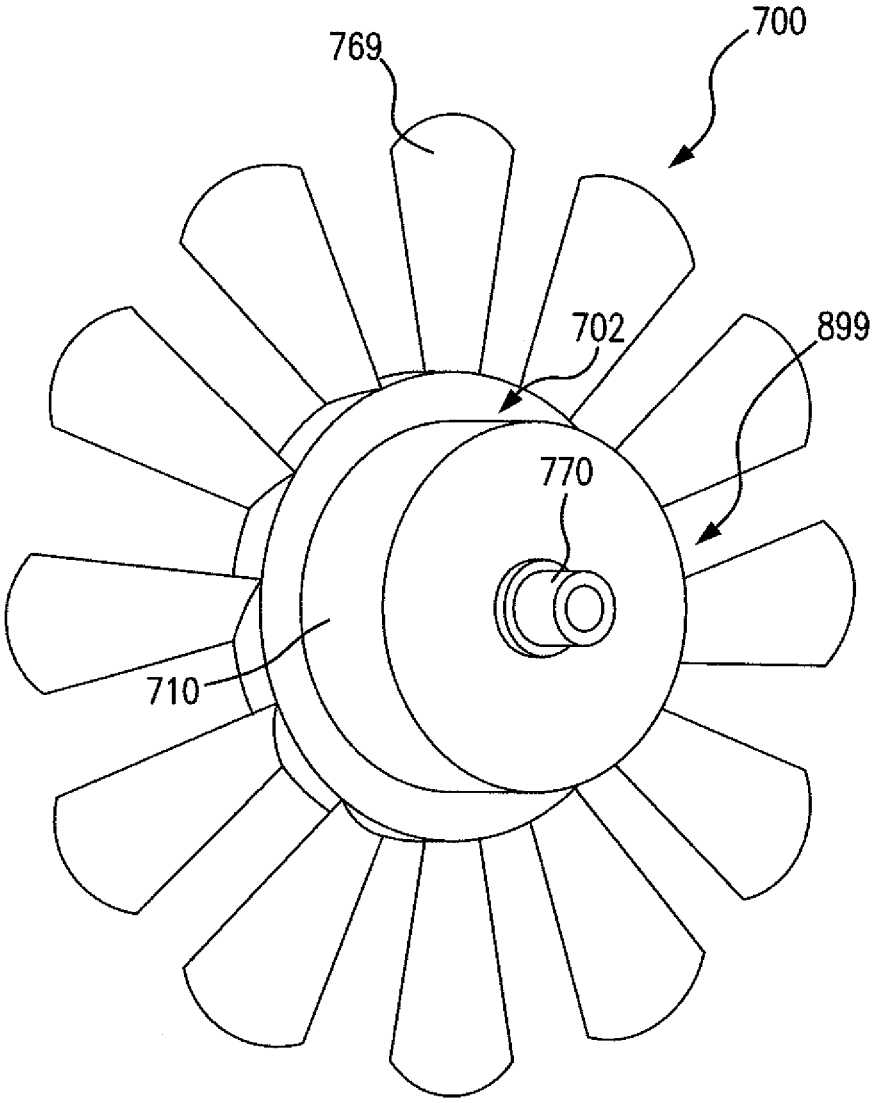
FIG. 24 is an embodiment of the cupped flywheel having a flywheel ring fan portion.

The application and use of a flywheel 700 which is a cantilevered flywheel 899, such as cupped flywheel 702 is not limited by this disclosure. In addition to a nailer 1, the cantilevered flywheel 899 which can be driven by an inner rotor motor 500 can be used with any power tool which can receive power from a flywheel directly or by means of a mechanism receiving power from the cantilevered flywheel 899. FIGS. 20 and 21 show examples to drive mechanisms which can use the cantilevered flywheel 899. FIGS. 22, 23 and 24 show examples types of power tool applications which can use the cantilevered flywheel 899. Power tools which can use the technology of this disclosure include but are not limited to fastening tools, material removal tools, grinders, sanders, polishers, cutting tools, saws, weed cutters, blowers and any power tool having a motor, such as in non-limiting example an inner rotor motor, whether brushed or brushless.

FIG. 20 is an embodiment of the cupped flywheel roller drive mechanism. In the example of FIG. 20, the flywheel ring 750 is a flywheel ring having flattened contact surface 761 having the contact surface 715 which is flattened in shape and which drives a first drive wheel 897 which drives a second drive wheel 898.

FIG. 21 is an embodiment of the cupped flywheel 702 having a flywheel ring 750 having axial gears. In the example of FIG. 21, the flywheel ring 750 is a flywheel ring having axial gears 763 which drives a gear 779.

FIG. 22 is an embodiment of the cupped flywheel 702 having the flywheel ring 750 which has a flywheel ring grinder portion 765.

FIG. 23 is an embodiment of the cupped flywheel 702 having the flywheel ring 750 which has a flywheel ring saw portion 767.

The cantilevered flywheel 899 can be used in any appliance which can receive power from a flywheel. FIG. 24 is an embodiment of the cupped flywheel 702 having the flywheel ring 750 which has a flywheel ring fan portion 769. The cantilever flywheel 899 can also be used in appliances such as fans, humidifiers, computers, printers, devices with brushed inner rotor motors, devices with brushless inner rotor motors and devices with motors having outer rotors. The cantilever flywheel 899 can also be used in automobiles, trains, planes and other vehicles. The cantilever flywheel 899 can be used in any device having an inner rotor motor.

The scope of this disclosure is to be broadly construed. It is intended that this disclosure disclose equivalents, means, systems and methods to achieve the devices, activities and mechanical actions disclosed herein. For each mechanical element or mechanism disclosed, it is intended that this disclosure also encompass in its disclosure and teach equivalents, means, systems and methods for practicing the many aspects, mechanisms and devices disclosed herein. Additionally, this disclosure regards a motor having a cantilevered flywheel and its many aspects, features, elements uses and applications. Such a device can be dynamic in its use an operation, this disclosure is intended to encompass the equivalents, means, systems and methods of the use of the tool and its many aspects consistent with the description and spirit of the operations and functions disclosed herein. The claims of this application are likewise to be broadly construed.

The description of the inventions herein in their many embodiments is merely exemplary in nature and, thus, variations that do not depart from the gist of the invention are intended to be within the scope of the invention. Such variations are not to be regarded as a departure from the spirit and scope of the invention.

We claim:

1. A power tool, comprising:

an electric motor having a stator and a rotor, the rotor having a rotor shaft;

said rotor shaft coupled to a flywheel;

said flywheel having an overlapping portion which is cantilevered over at least a portion of said stator;

said flywheel having a contact surface adapted to impart energy from said flywheel when contacted by a moveable member; and said overlapping portion adapted to rotate radially about said at least a portion of said stator;

wherein said rotor is an inner rotor;

wherein said electric motor is a brushed motor; and wherein said overlapping portion includes the contact surface;

wherein the contact surface comprises a flywheel ring including at least one groove; and wherein the movable member is a driver which includes a driver profile configured to frictionally engage the flywheel ring.

2. The power tool according to claim 1, wherein the overlapping portion is cantilevered over at least a portion of said rotor.

3. The power tool according to claim 1, wherein said flywheel ring and said rotor shaft rotate in a ratio in a range of between 0.5:1.5 and 1.5:0.5.

4. The power tool according to claim 3, wherein said flywheel ring rotates at a speed in a range of from about 2500 rpm to about 20000 rpm.

5. The power tool according to claim 3, wherein the contact surface which has a speed in a range of from about 20 ft/s to about 200 ft/s.

6. The power tool according to claim 3, wherein said flywheel ring has an inertia in a range of from about 10 J(kg*m^2) to about 500 J(kg*m^2).

7. The power tool according to claim 1, wherein said flywheel ring and said rotor shaft rotate in a ratio of about 1:1.

8. The power tool according to claim 1, wherein said power tool is a nailer adapted to drive a nail.

9. The power tool according to claim 1, wherein said flywheel ring rotates at a speed in a range of from about 5600 rpm to about 10000 rpm.

10. A fastening device, comprising:

a motor having a stator;

a cantilevered flywheel driven by the motor;

said cantilevered flywheel having a contact surface adapted for frictional contact with a driving member adapted to drive a fastener;

said cantilevered flywheel having an overlapping portion which is cantilevered over at least a portion of said stator;

wherein said motor has an inner rotor;

wherein the overlapping portion includes the contact surface;

wherein the contact surface includes at least two grooves; and wherein the motor is a brushed motor.

11. The fastening device according to claim 10, wherein said cantilevered flywheel is a cupped flywheel.

12. The fastening device according to claim 10, wherein said cantilevered flywheel is adapted to have a flywheel energy in a range of from about 10 j to about 1500 j.

13. A power tool, comprising:

a motor having a stator and a rotor, the rotor having a rotor axis;

a flywheel adapted for turning by said motor, said flywheel having a flywheel portion coaxial to said rotor axis;

said flywheel portion at least in part located over at least a portion of said stator;

wherein said flywheel is a cupped flywheel having a cupped flywheel portion which radially surrounds at least a portion of said stator;

wherein the flywheel has a flywheel ring;

wherein the flywheel ring includes at least one groove;

the power tool further comprising a driver, the driver receiving energy from the flywheel to drive a nail;

wherein the driver includes a driver profile configured to engage the flywheel ring; and wherein the flywheel ring is disposed on the cupped flywheel portion of the flywheel.

14. The power tool of claim 13, wherein the rotor has a rotor longitudinal axis and a rotor shaft extending along the rotor longitudinal axis, the rotor shaft rotating along with the rotor;

wherein the stator is positioned radially outside of the rotor; and wherein the flywheel is attached to the rotor shaft.

15. The power tool of claim 14, wherein flywheel ring includes at least two grooves.

16. The power tool of claim 15, further comprising a motor housing, the motor housing located outside of the stator and at least partially surrounding the rotor and the stator; and wherein the flywheel overlaps at least a portion of the motor housing.

17. The power tool of claim 13, wherein the motor is a brushed motor.

* * * * *